US012703971B2

(12) United States Patent
Lambert et al.

(10) Patent No.: US 12,703,971 B2
(45) Date of Patent: Aug. 11, 2026

(54) FLUSH ENGINE

(71) Applicant: Kohler Co., Kohler,, WI (US)

(72) Inventors: Tony L. Lambert, Sheboygan, WI (US); Andrew L. Smith, Sheboygan, WI (US); Michael Smith, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 84 days.

(21) Appl. No.: 18/775,928

(22) Filed: Jul. 17, 2024

(65) Prior Publication Data

US 2025/0034853 A1 Jan. 30, 2025

Related U.S. Application Data

(60) Provisional application No. 63/621,040, filed on Jan. 15, 2024, provisional application No. 63/529,550, filed on Jul. 28, 2023.

(51) Int. Cl.
*E03D 1/34* (2006.01)

(52) U.S. Cl.
CPC ..... *E03D 1/34* (2013.01); *E03D 2201/40* (2013.01)

(58) Field of Classification Search
CPC ..... E03D 1/34
See application file for complete search history.

(56) References Cited

U.S. PATENT DOCUMENTS 4,999,859 A 3/1991 Bolze
5,078,180 A * 1/1992 Collins ..... B60R 15/00 251/30.05
7,284,286 B1 10/2007 Kopplin
8,032,956 B2 10/2011 Prokopenko
8,230,533 B2 7/2012 Jorsch
8,291,525 B2 * 10/2012 Pondelick ..... E03D 11/02 4/316
8,566,971 B2 10/2013 Stauber
9,045,888 B2 6/2015 Stauber
9,988,802 B1 * 6/2018 Smith ..... E03D 11/02
(Continued)

FOREIGN PATENT DOCUMENTS

CN 205314198 U 6/2016
CN 115917195 A 4/2023
(Continued)

OTHER PUBLICATIONS

Extended European Search Report from European Patent Application No. 24189855.0, dated Nov. 28, 2024, 49 pages.

*Primary Examiner* — Christine J Skubinna
(74) *Attorney, Agent, or Firm* — Lempia Summerfield Katz LLC

(57) ABSTRACT

Provided is a system for flushing a toilet including a flow controller having a housing including an inlet configured to receive a first flow of water, a first outlet, and a second outlet. The flow controller may further include a hydraulic turbine disposed in the housing in fluid communication with the inlet and configured to generate power as the first flow of water travels therethrough, a rim valve disposed in the housing in fluid communication with the inlet and configured to control a second flow of water provided to the first outlet, and a sump jet valve disposed in the housing in fluid communication with the inlet and configured to control a third flow of water provided to the second outlet.

18 Claims, 17 Drawing Sheets

(56) References Cited

U.S. PATENT DOCUMENTS

| | | | |
|---|---|---|---|
| 10,066,380 | B2 | 9/2018 | Jorsch |
| 10,145,097 | B2 | 12/2018 | Mchale |
| 10,392,790 | B2 | 8/2019 | Seike |
| 10,428,509 | B2 | 10/2019 | Smith |
| 10,927,537 | B2 | 2/2021 | Mukerji et al. |
| 10,961,694 | B2 | 3/2021 | Garrels |
| 11,021,863 | B2 | 6/2021 | Smith et al. |
| 11,230,832 | B2 | 1/2022 | Luettgen |
| 11,566,409 | B2 | 1/2023 | Sun |
| 2018/0245324 | A1 | 8/2018 | Seike |
| 2020/0190784 | A1 | 6/2020 | Mchale |
| 2020/0340226 | A1 | 10/2020 | Cole |
| 2021/0102364 | A1 | 4/2021 | Mukerji |
| 2021/0189709 | A1 | 6/2021 | Garrels |
| 2022/0106782 | A1 | 4/2022 | Luettgen |
| 2022/0163370 | A1 | 5/2022 | Hall |
| 2023/0069719 | A1 | 3/2023 | Tran |

FOREIGN PATENT DOCUMENTS

| | | | | |
|---|---|---|---|---|
| EP | 0653002 | B1 | 9/1997 | |
| EP | 3063338 | B1 | 6/2023 | |
| GB | 2159187 | A | 11/1985 | |
| JP | 2006063591 | A | 3/2006 | |
| JP | 2007077793 | A | 3/2007 | |
| JP | 2009007847 | A | 1/2009 | |
| JP | 4305359 | B2 | 5/2009 | |
| JP | 5447706 | B1 | 1/2014 | |
| KR | 20050000186 | A | 1/2005 | |
| WO | 2016104495 | A1 | 6/2016 | |
| WO | WO-2021250309 | A1 * | 12/2021 | ..... F16K 27/044 |

* cited by examiner

FLUSH ENGINE

CROSS-REFERENCE TO RELATED APPLICATIONS

This application claims priority benefit of Provisional Application No. 63/529,550 filed on Jul. 28, 2023, and Provisional Application No. 63/621,040 filed on Jan. 15, 2024, both of which are hereby incorporated by reference in their entirety.

FIELD

The present application relates generally to toilets. More specifically, the present disclosure relates to flush engines for improved performance of toilets.

BACKGROUND

Generally, toilets including in-line pressure flush engines require high in-line water pressure operate. In-line pressure flush engines receiving water under insufficient pressure may operate poorly, failing to adequately remove waste from and rinse the bowl. Many buildings (e.g., commercial, residential) may not receive water under sufficient in-line pressure for in-line pressure flush engines to operate reliably. Accordingly, there is a need for an in-line flush engine capable of reliably flushing under lower in-line pressure.

BRIEF DESCRIPTION OF THE DRAWINGS

Objects, features, and advantages of the present disclosure should become more apparent upon reading the following detailed description in conjunction with the drawing figures, in which.

The figures illustrate certain exemplary embodiments of the present disclosure in detail. It should be understood that the present disclosure is not limited to the details and methodology set forth in the detailed description or illustrated in the figures. It should be understood that the terminology used herein is for the purposes of description only and should not be regarded as limiting.

DETAILED DESCRIPTION

Described herein are devices, systems, and methods for flushing in-line toilets. Specifically, described herein are gate valves and flush assemblies for flushing in-line toilets. The gate valves and flush assemblies described herein may advantageously allow a toilet supplied with water at a relatively low pressure to be reliably flushed.

Figure 1:
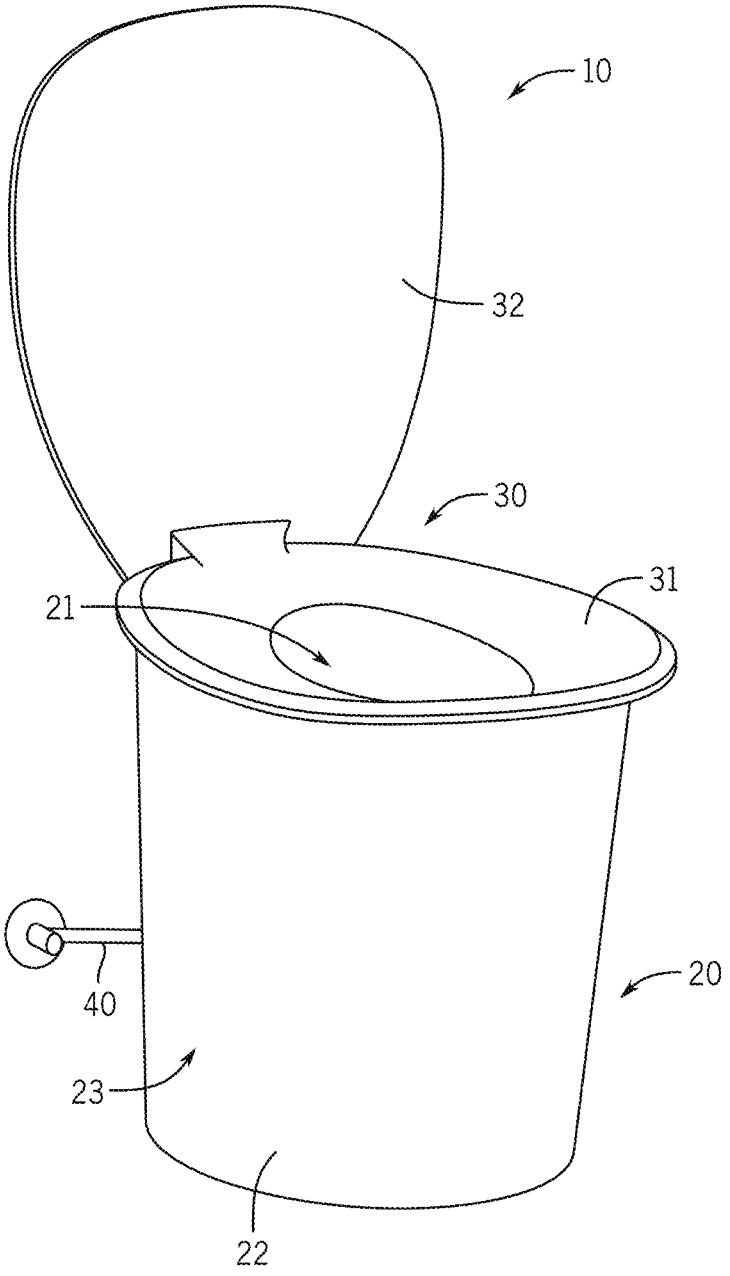
FIG. 1 illustrates a perspective view of a toilet in accordance with one example of the present disclosure.

FIG. 1 illustrates a toilet 10 in accordance with one example of the present disclosure. Specifically, FIG. 1 illustrates an in-line toilet 10 including a pedestal or base 20 and a seat assembly 30. The toilet 10 includes an actuator that is configured to initiate an operational cycle when activated. The actuator may be a button configured to activate when depressed (or pulled) a predetermined distance or when touched, or any suitable device configured to activate based upon an input manipulation by a user. In some examples, an operational cycle may be initiated using one or more control signals sent wirelessly (e.g., via the internet) from a computer (e.g., cell phone) to the toilet 10.

It should be noted that the shapes and configurations of the base 20, seat assembly 30, and the internal components (including the trapway and other features) may vary from the embodiments shown and described herein, and that the embodiments disclosed herein are not intended as limitations. It should be noted that various components of the toilet may be made of a vitreous material such as clay. It should be noted that various components of the toilet may be polymeric and/or over molded or otherwise fixed to the toilet. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The base 20 of the toilet 10 may include a wall 23 having any suitable shape that is configured to form a bowl 21 having an opening formed by an upper rim at the top of the opening. The base 20 may also be configured to include a plurality of walls having varying shapes that together form a bowl having an opening formed by a rim. The wall 23 of the pedestal may extend downward and/or rearward from the bowl 21 to form a lower portion 22 configured to support the base 20 and the toilet 10. The lower portion 22 may be formed by the end (e.g., lower rim) of the wall 23, or may include a member that extends generally in a horizontal plane from one or more than one end of the wall 23.

The base 20 may also include a top member that extends between two sides of the wall 23 (or between two opposing walls) and is provided rearward (or behind) the bowl 21, wherein the top member forms a plateau for supporting the seat assembly 30. For example, the top member may include one or more than one opening, wherein each opening is configured to receive a fastening device (e.g., bolt, screw, etc.) to couple (e.g., attach) the seat assembly 30 to the top member of the base 20. As another example, the top member may include one or more than one fastening device (e.g., bolts, recessed nuts, etc.) integrally formed therein (i.e., already provided connected or coupled to the base 20), wherein the fastening device may be used to couple or secure at least a portion of the seat assembly 30 to the base 20. The seat assembly 30 may include a hinge, hinge shoulders configured to receive a fastener, a seat coupled to the hinge and a cover coupled to the hinge.

The bowl 21 of the base 20 may be configured to include a receptacle (e.g., sump) and an outlet opening, wherein the water and waste is collected in the receptacle until being removed through the outlet opening, such as upon activation of the actuator. The base 20 may also include a base internal passageway, such as a trapway, that connects the outlet opening or discharge outlet of the bowl 21 to a drain or soil pipe. The passageway, or trapway, generally includes a first portion, a second portion, and a weir separating the first and second portions. The first portion of the passageway may extend from the outlet opening of the bowl 21 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator. Upon activation of the actuator, additional water (e.g., from an in-line water supply 40) may be discharged into the bowl 21 of the base 20, resulting in the flushing action and waste removal through the soil pipe. For example, water may be discharged into the bowl from one or more rim outlets located in or below a rim of the toilet and/or a sump jet disposed in a sump (e.g., first part of the trapway) of the toilet. The flushing cycle may include generation of a siphon to assist the flushing action and waste removal.

The seat assembly 30 may include a cover member 32 (e.g., lid), a seat member 31 (e.g., ring member), and a hinge. The seat member 31 may be configured to include an annular member that encircles an opening, wherein the annular member provides a seating surface for the user of the toilet 10. The seat member 31 may also be pivotally coupled (e.g., attached) to the hinge, wherein the seat member may rotate (or pivot) about the hinge, such as between a first lowered or seated position and a second raised or upright position. The cover member 32 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 32 may also be coupled to the hinge, wherein the cover member may rotate (or pivot) about the hinge, such as between a first lowered or down position and a second raised or upright position. The cover member 32 may be provided above the seat member in the down position to thereby cover the opening of the seat member 31, as well as to conceal the inside of the bowl 21 of the base 20. The cover member 32 may be configured to be disposed in an upright position, such that the cover member 32 remains in the upright position in order for a user to sit upon the seat member 31.

Figure 2:
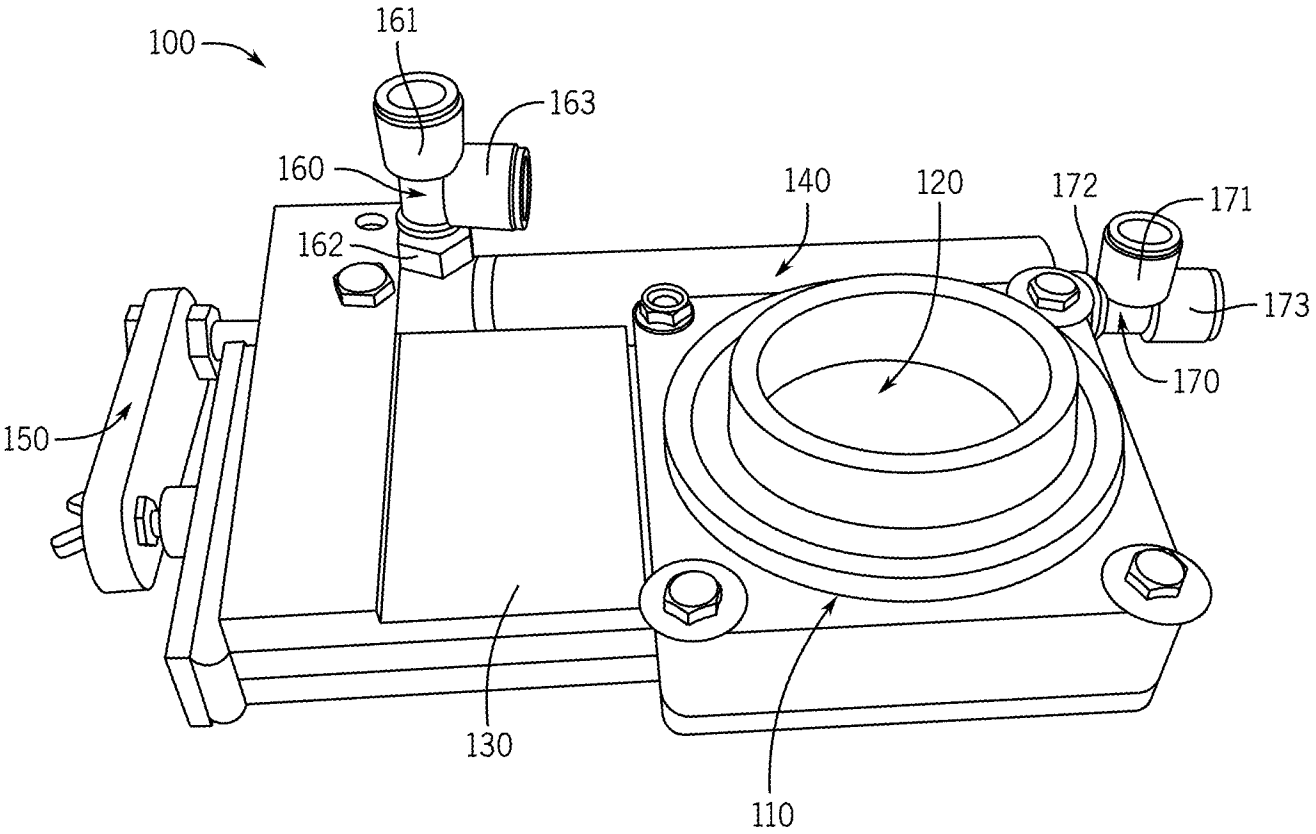
FIG. 2 illustrates a front perspective view of a gate valve in accordance with one examples of the present disclosure.
Figure 3:
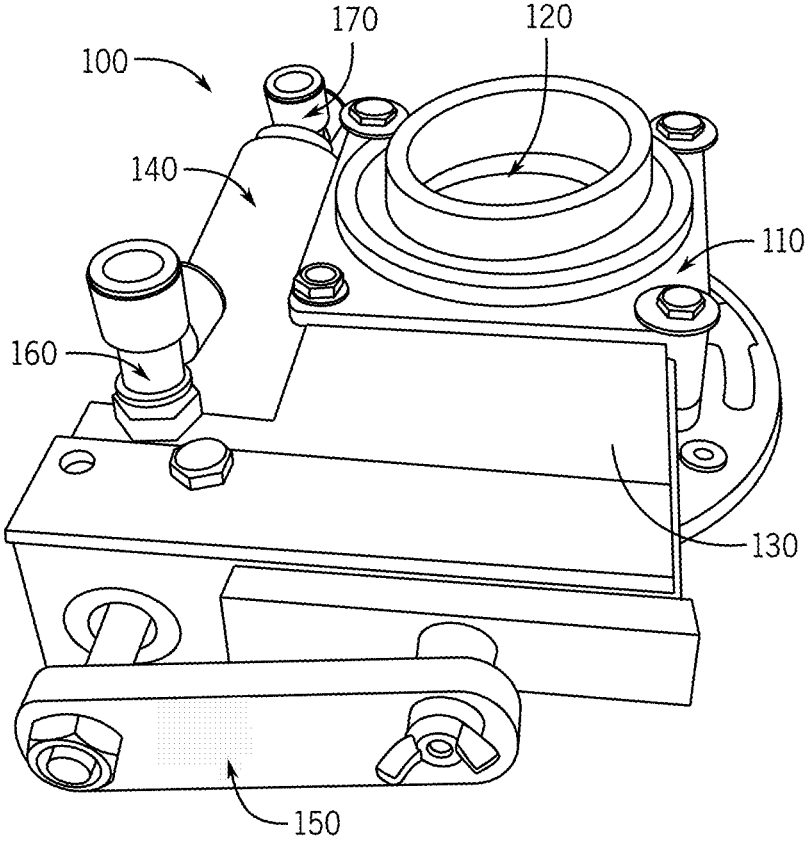
FIG. 3 illustrates a side perspective view of the gate valve of FIG. 3 in accordance with one examples of the present disclosure.

Referring to FIGS. 2 and 3, a gate valve 100 in accordance with one example of the present disclosure. The gate valve 100 includes a housing 110, an opening 120 extending through the housing 110, a gate 130 configured to selectively block the opening 120, and a hydraulic cylinder 140 coupled to the gate via one or more linkages 150. The gate valve 100, specifically the opening 120 extending through the gate valve 100 may be configured to be disposed in a trapway of a toilet (e.g., toilet 10). The gate 130 may be configured to selectively block the opening 120, preventing the contents of a toilet bowl or sump from flowing past the gate valve 100 to an exiting device (e.g., drain or soil pipe).

In some examples, as illustrated in FIGS. 2 and 3, the housing may have the shape of a hollow rectangular prism; however, the present disclosure is not limited thereto, and a shape of the housing may vary. The housing 110 includes an opening 120 extending therethrough. In some examples, two opposite sides of the housing 110 may include the opening 120 extending therethrough. In some examples, the gate 130 may be disposed within the housing 110. In other examples, as illustrated in FIGS. 2 and 3, the housing 110 may include a slot. The slot may be disposed on a side of the housing between the sides including the openings. The slot may be configured to receive the gate 130 and may have a shape corresponding to a side of the gate 130. In some examples, as illustrated in FIG. 2, the gate 130 may remain disposed in the slot even when the gate valve 100 is open.

In some examples, as illustrated in FIG. 2, the opening 120 may have a substantially circular shape, however, the present disclosure is not limited thereto. For example, the opening may have an oval or polygon shape. In some examples, the opening 120 may have a shape corresponding to the shape of a trapway in which the gate valve 100 is disposed.

The gate 130 may be configured to selectively block the opening 120 extending through the housing 110. In some examples, as illustrated in FIGS. 2 and 3, the gate valve may have a square or polygon cross sectional shape; however, the present disclosure is not limited thereto. For example, the gate valve 130 may have a round (e.g., circular, oval) cross sectional shape. The gate valve 130 may be configured to translate between an open position and a closed position in a plane perpendicular the opening 120 extending through the housing 110. In the closed position the gate 130 may block the opening 120. In some examples, the gate 130 may completely block the opening 120 when it is in the closed position. For example, the gate 130 may be larger than the opening 120, such that in the closed position, the gate 130 completely blocks the opening 120. In the open position, the gate 130 may be disposed adjacent to the opening 120 and my not block the opening 120. For example, during an operational cycle of a toilet, the gate 130 may begin in a closed position preventing water and/or waste from flowing through a trapway. In some examples, the closed gate may allow the trapway to be pre-primed (i.e., filled with water). At some point during an operational cycle of the toilet, the gate may be moved to an open position, allowing the water and/or waste to flow through the gate valve 100. A siphon may be formed when the gate 130 is moved to the open position. The gate 130 may be connected to the hydraulic cylinder 140 through one or more linkages 150.

Figure 11:
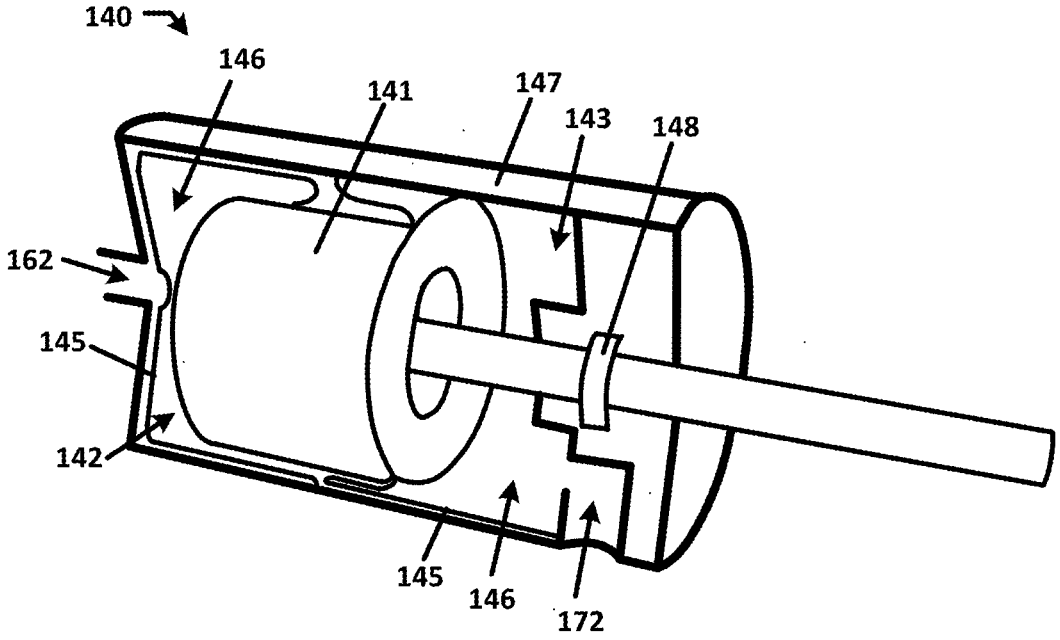
FIG. 11 illustrates a hydraulic cylinder in accordance with one example of the present disclosure.

Referring generally to FIGS. 3 and 11, a hydraulic cylinder 140 in accordance with one example of the present disclosure is illustrated. The hydraulic cylinder 140 may include a first inlet 160 and a second inlet 170. The first inlet 160 may be disposed at a first end 142 of the hydraulic cylinder 140 and the second inlet 170 may be disposed at a second end 143 of the hydraulic cylinder 140. The first inlet 160 may include a first passage 161 configured to receive a flow of fluid from a fluid supply, for example, an in-line water supply, a second passage 162 configured to convey a flow of fluid to the hydraulic cylinder, and a third passage 163 configured to convey a flow of fluid to a rim outlet of a toilet (e.g., 10). The second inlet 170 may include a first passage 171 configured to receive a flow of fluid from a fluid supply, a second passage 172 configured to convey a flow of fluid to the hydraulic cylinder, and a third passage 173 configured to convey a flow of fluid to a sump jet outlet of a toilet (e.g., 10). Operation of the hydraulic cylinder 140 is described below with respect to FIG. 4.

As illustrated in FIG. 11, the first inlet 160, specifically, the second passage 162 of the first inlet 160, may be connected to and in communication with the first end 142 of the hydraulic cylinder 140. Additionally, the second inlet 170, specifically, the second passage 172 of the second inlet 170, may be connected to and in communication with the second end 143 of the hydraulic cylinder 140. The first inlet 160 (e.g., second passage 162 of the first inlet 160) may be configured to convey a flow of fluid (e.g., water) to the first end 142 of the hydraulic cylinder 140. The second inlet 170 (e.g., second passage 172 of the second inlet 170) may be configured to convey a flow of fluid to the second end 143 of the hydraulic cylinder 140.

Still referring to FIG. 11, the hydraulic cylinder 140 may further include a piston 141 disposed within the hydraulic cylinder 140. The piston 141 may be free to move within the hydraulic cylinder 140. The piston may be disposed between the first inlet 160 and the second inlet 170. In some examples, the hydraulic cylinder 140 may further include a lining 145. The lining 145 may create a water cavity or reservoir 146 into which fluid is conveyed (e.g., via the first inlet 160, second inlet 170). In some examples, the hydraulic cylinder 140 may include a single cavity or reservoir 146. In some examples, the hydraulic cylinder 140 may include two or more reservoirs 146. For example, the hydraulic cylinder 140 may include two or more linings 145, each of which is configured to create an independent or isolated reservoir 146. For example, a reservoir 146 may be included on each side (e.g., first end 142 and second end 143) of the piston 141. As illustrated in FIG. 11, the hydraulic cylinder includes two liners 145 and two reservoirs 146, with one reservoir 146 disposed on each side of the piston 141. In other examples two or more reservoirs (e.g., 146) may be disposed on each side of the piston 141. In some examples, the one or more liners 145 may prevent water or another fluid from contacting with the moving parts of the hydraulic cylinder 140 preventing corrosion of the moving parts of the hydraulic cylinder 140.

Additionally, in some examples, the hydraulic cylinder 140 may include an outer sealed shell 147 surrounding the one or more reservoirs 146 included in the hydraulic cylinder 140. The outer sealed shell 147 may protect the one or more reservoirs 146 and may contain fluid within the hydraulic cylinder 140, for example, in the event that a lining 145 or reservoir 146 ruptures. Additionally, the hydraulic cylinder 140 may include a mechanism (e.g., lever) configured to manually open and/or close the hydraulic cylinder 140. For example, the lever may be used to open the hydraulic cylinder 140, such that the gate valve 130 is moved to an open position, preventing overflow of a toilet including the hydraulic cylinder 140. In some examples, the one or more liners 145 may be a coating sprayed on (e.g., an interior of) the hydraulic cylinder 140. In some examples, the hydraulic cylinder 140 may include one or more sealing members 148 (e.g., O-rings) configured to prevent water or fluid from contacting the moving parts (e.g., piston 141) of the hydraulic cylinder 140.

Figure 4:
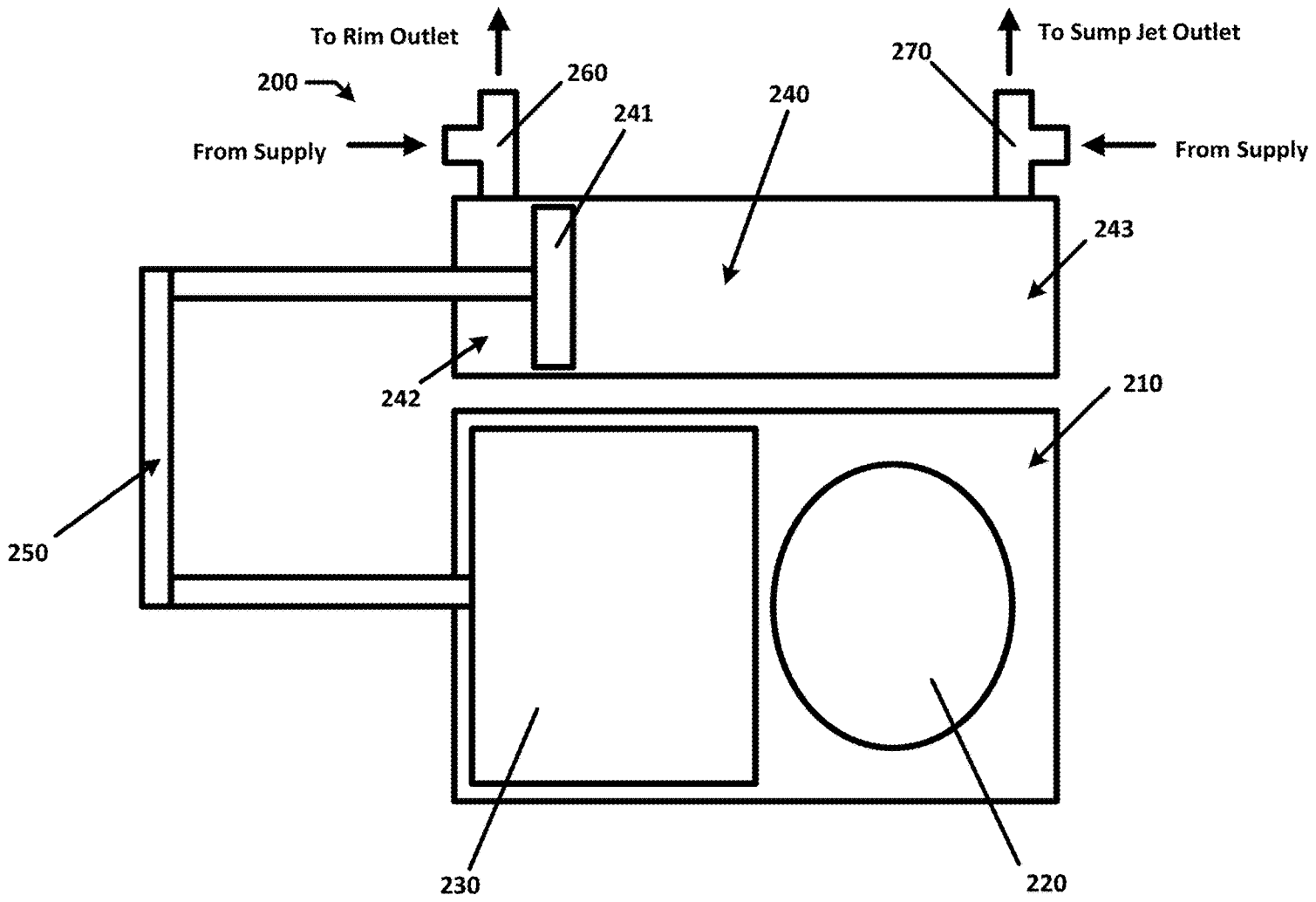
FIG. 4 illustrates a cross-sectional view of a gate valve in accordance with one example of the present disclosure.

Referring to FIG. 4, a cross-sectional view of a gate valve 200 in accordance with one example of the present disclosure is illustrated. The gate valve 200 includes a housing 210, an opening 220 extending through the housing 210, a gate 230 configured to selectively block the opening 220, and a hydraulic cylinder 240 coupled to the gate via one or more linkages 250. The gate valve 200 may be substantially similar to the gate valve 100 described above with respect to FIGS. 2 and 3 of the present disclosure; however, in the gate valve 200, the gate 230 may remain in the housing 210 when the gate 230 is in an open position. The housing 210, opening 220, gate 230, and hydraulic cylinder 240 may be the same as the housing 110, opening 120, gate 130, and hydraulic cylinder 140 described above with respect to FIGS. 2 and 3.

As illustrated in FIG. 4, the hydraulic cylinder 240 may include a first inlet 260 connected to and in fluid communication with a first end 242 of the hydraulic cylinder 240. Additionally, the hydraulic cylinder 240 may include a second inlet 270 connected to and in fluid communication with a second end 243 of the hydraulic cylinder 240. The first inlet 260 may be configured to convey a flow of fluid (e.g., water) into the first end 242 of the hydraulic cylinder 240 and the second inlet 270 may be configured to convey a flow of fluid into the second end 243 of the hydraulic cylinder 240.

The hydraulic cylinder 240 may further include a piston 241 disposed within the hydraulic cylinder 240. The piston 241 may be free to move within the hydraulic cylinder 240. In some examples, the piston 241 may be disposed between the first inlet 260 and the second inlet 270. When a flow of fluid is supplied through the first inlet 260 into the first end 242 of the hydraulic cylinder 240, the piston 241 may be moved toward the second end 243 of the hydraulic cylinder 240. Specifically, a pressure of the fluid in the first end 242 of hydraulic cylinder may be greater than a pressure of fluid in the second end 243 of the hydraulic cylinder 240, causing the piston to move toward the second end 243 of the hydraulic cylinder 240. Conversely, when a flow of fluid is supplied through the second inlet 270 into the second end 243 of the hydraulic cylinder 240, the piston 241 may be moved toward the first end 242 of the hydraulic cylinder 240. Specifically, a pressure of fluid in the second end 243 of the hydraulic cylinder 240 may be greater than a pressure of fluid in the first end 242 of the hydraulic cylinder 240, causing the piston 241 to move toward the first end 242 of the hydraulic cylinder 240.

As illustrated in FIG. 4, the piston 241 may be connected to the gate 230 via one or more linkages 250. In some examples, as illustrated in FIG. 4, the hydraulic cylinder 240 may be disposed adjacent to the housing 210 and the linkages may have a substantially "U" shape extending from the piston 241 to the gate 230. In other examples, the hydraulic cylinder may be disposed in line with the housing and a linear linkage may extend between the piston and the gate.

The one or more linkages 250 connecting the piston 241 and the gate 230 may cause the gate 230 to move as the piston 241 moves. Accordingly, in some examples, as the piston 241 moves toward the second end 243 of the hydraulic cylinder 240 (e.g., toward the second inlet 270) the linkage 250 may cause the gate 230 to move (e.g., slide)

toward and eventually to a closed position in which the gate 230 complete blocks the opening 220. In some examples, when the gate 230 is in the closed position, the gate 230 may abut an interior of the housing 210, preventing the piston 241 from moving further toward the second end 243 of the hydraulic cylinder 240. Similarly, when the piston 241 moves towards the first end 242 of the hydraulic cylinder 240 (e.g., toward the first inlet 260) the linkage 250 may cause the gate 230 to move (e.g., slide) toward and eventually to an open position in which the gate 230 does not block the opening. In some examples, when the gate 230 is in the open position, the gate 230 may abut an interior surface of the housing 210, preventing the piston 241 from moving further toward the first end 242 of the hydraulic cylinder 240.

Figure 5:
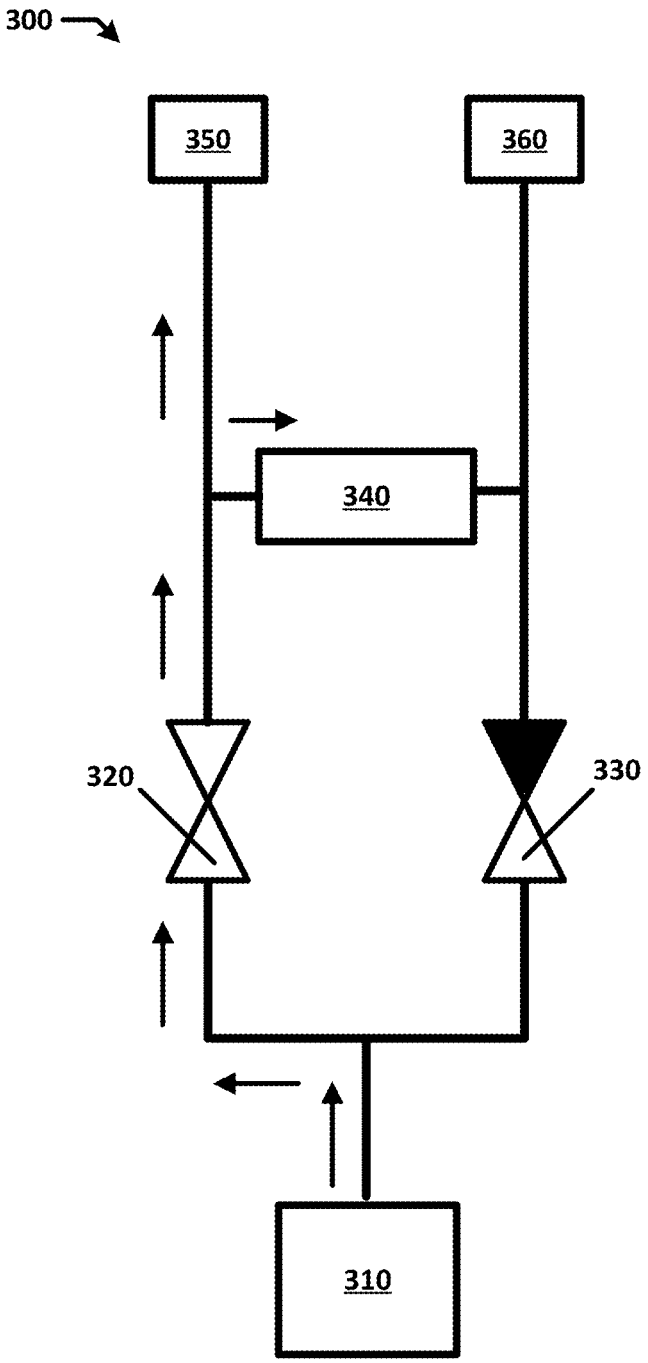
FIG. 5 illustrates a flush engine in a first state in accordance with one example of the present disclosure.
Figure 6:
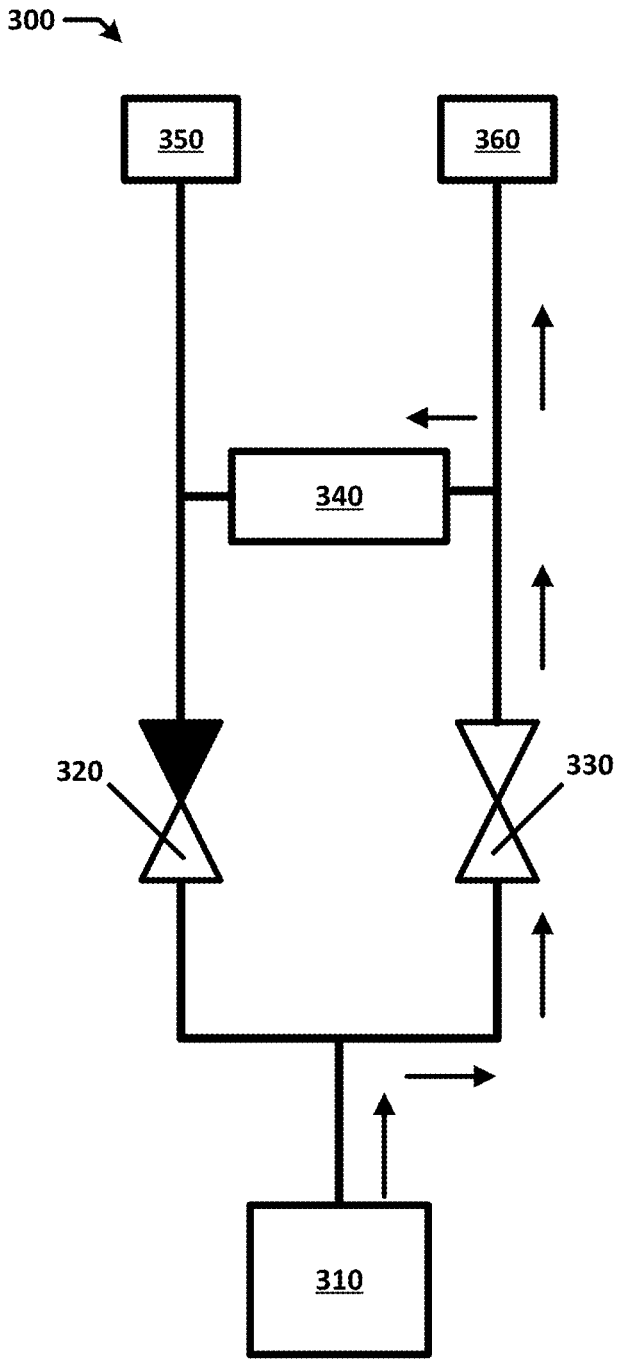
FIG. 6 illustrates the flush engine of FIG. 5 in a second state in accordance with one example of the present disclosure.

Referring to FIGS. 5 and 6, a flush engine 300 in accordance with one example of the present disclosure is illustrated. The flush engine 300 includes a water supply 310, a rim valve or first valve 320, a jet valve or second valve 330, a gate valve 340, a rim outlet 350, and a sump jet outlet 360. The gate valve 340 may be the gate valve 100 described with respect to FIGS. 2 and 3 or the gate valve 200 described above with respect to FIG. 4. The first valve 320 and the second valve 330 may be in fluid communication with the water supply 310. In some examples, the water supply 310 may be a building (e.g., residential, commercial) water distribution network. In other examples, the water supply may be a well or another source.

The first valve 320 may be configured to selectively supply a flow of water from the water supply 310 to the gate valve 340 and the rim outlet 350. Specifically, the first valve 320 may be configured to selectively supply a flow of water to a first end (e.g., 242) of a hydraulic cylinder (e.g., 140, 240) included in the gate valve 340. As described above with respect to FIG. 4, as a flow of water is supplied to the first end of the hydraulic cylinder, a piston (e.g., 241) disposed in the hydraulic cylinder may move toward a second end (e.g., 243) or remain at a second end of the hydraulic cylinder. As the piston moves towards the second end of the hydraulic cylinder, a linkage (e.g., 150, 250) extending between the piston 241 and a gate (e.g., 230) may cause the gate to move towards a closed position in which an opening (e.g., 220) is blocked by the gate. In some examples, when the gate is already in the closed position, a flow of water into the first end of the hydraulic cylinder may maintain a position of the piston, and via the linkage maintain a position of the gate. In some examples, the first valve 320 may be a solenoid valve.

Additionally, the first valve 320 may selectively supply a flow of water to the rim outlet 350 disposed at or near a rim of the toilet (e.g., 10). In some examples, the rim outlet 350 may be positioned downstream of the gate valve 340 such that water flowing through the first valve flows into the first end of the hydraulic cylinder, closing the gate valve 340, before flowing through the rim outlet 350. In some examples, the flow of water through the first valve 320 may flow into the hydraulic cylinder, moving the piston to the second end of the hydraulic cylinder, corresponding to a closed position of the gate, before flowing to the rim outlet 350. The flow of water supplied to the rim outlet may be used for rinsing and/or filling the bowl the toilet.

The second valve 330 may be configured to selectively supply a flow of water from the water supply 310 to the gate valve 340 and the sump jet outlet 360. Specifically, the second valve 330 may be configured to selectively supply a flow of water to a second end (e.g., 243) of a hydraulic cylinder (e.g., 140, 150) included in the gate valve 340. As described above with respect to FIG. 4, as a flow of water is supplied to the second end 243 of the hydraulic cylinder, a piston (e.g., 241) disposed in the hydraulic cylinder may move toward a first end (e.g., 242) or remain at a first end of the hydraulic cylinder. As the piston moves towards the first end of the hydraulic cylinder, a linkage (e.g., 150, 250) extending between the piston 241 and a gate (e.g., 230) may cause the gate to move towards an open position in which an opening (e.g., 220) is not blocked by the gate. In some examples, when the gate is already in the open position, a flow of water into the second end of the hydraulic cylinder may maintain a position of the piston, and via the linkage maintain a position of the gate. In some examples, the second valve 330 may be a solenoid valve.

Additionally, the second valve 330 may selectively supply a flow of water to the sump jet outlet 360 disposed at a sump of the toilet (e.g., 10). In some examples, the sump jet outlet 360 may be positioned downstream of the gate valve 340 such that water flowing through the second valve 330 flows into the second end of the hydraulic cylinder, opening the gate valve 340, before flowing through the sump jet outlet 360. In some examples, the flow of water through the second valve 330 may flow into the hydraulic cylinder, moving the piston to the first end of the hydraulic cylinder, corresponding to an open position of the gate, before flowing to the sump jet outlet 360.

Referring to FIG. 5, the flush engine 300 is illustrated in a state in which the first valve 320 is open allowing a flow of water to the gate valve 340 (e.g., a first end 242 of the gate valve) and to the rim outlet 350. As illustrated in FIG. 5, the second valve 330 may be closed when the first valve 320 is open. The second valve 330 may be closed when the first valve 320 so as to ensure a piston (e.g., 241) dispose in the hydraulic cylinder (e.g., 140, 240) is disposed at a second end (e.g., 243) of the hydraulic cylinder corresponding to a closed position or state of the gate valve 340.

Referring to FIG. 6, the flush engine 300 is illustrated in a state in which the second valve 330 is open allowing a flow of water to the gate valve 340 (e.g., a second end 243 of the gate valve) and to the sump jet outlet 360. As illustrated in FIG. 6, the first valve 320 may be closed when the second valve 330 is open. The first valve 320 may be closed when the second valve is open so as to ensure a piston (e.g., 241) disposed in the hydraulic cylinder (e.g., 140, 240) is disposed at a first end (e.g., 242) of the hydraulic cylinder corresponding to an open position or state of the gate valve 340.

Figure 7:
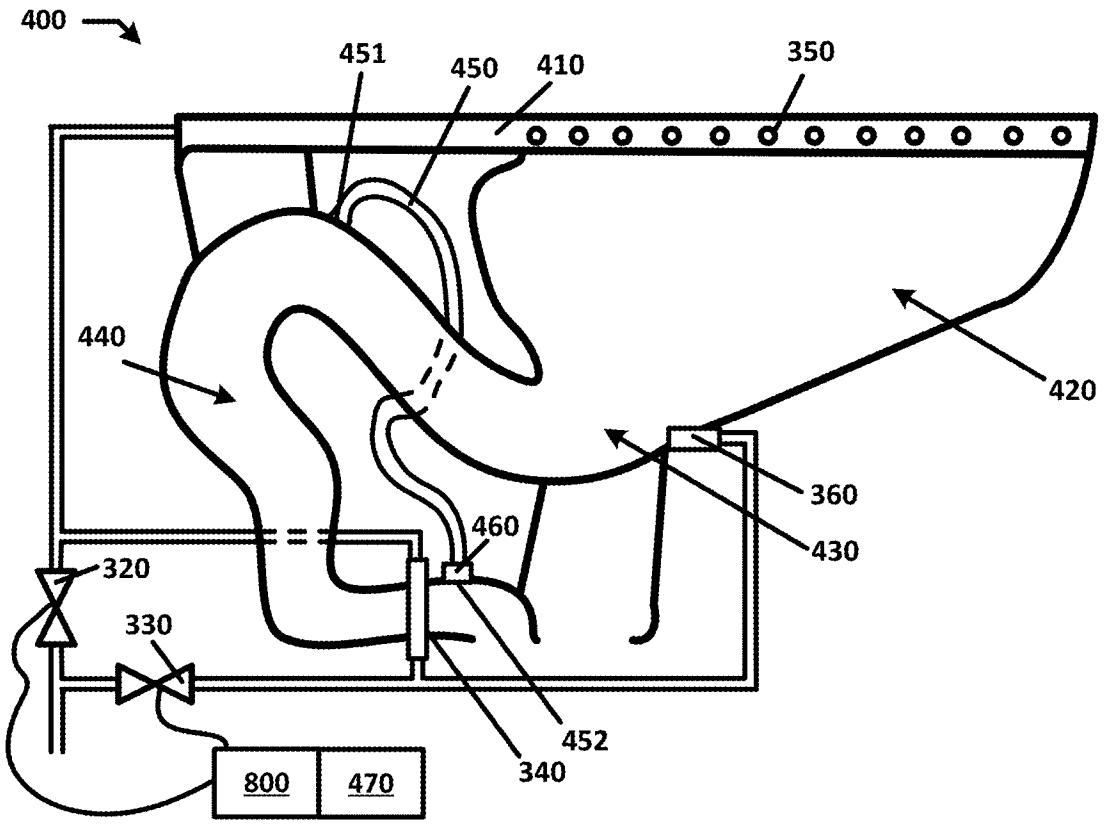
FIG. 7. Illustrates a toilet in accordance with one example of the present disclosure.

Referring to FIG. 7, a toilet 400 in accordance with one example of the present disclosure is illustrated. The toilet 400 includes the flush engine 300 described above with respect to FIGS. 5 and 6. Specifically, the toilet 400 includes the first valve 320, the second valve 330, the gate valve 340, the rim outlet 350, and the sump jet outlet 360. Further, as illustrated in FIG. 7, the toilet 400 includes a rim channel 410, bowl 420, sump 430, and trapway 440. The rim channel 410 may be disposed within and/or along a rim of the toilet 400. The rim channel may be in fluid communication with one or more rim outlets 350 configured to dispense water into the bowl 420. The bowl 420 may be in communication with and/or include the sump 430 disposed at a bottom of the bowl 420. The sump 430 may be a receptacle configured to hold water and/or waste during an operational cycle of the toilet 400. The sump 430 may be in communication with the trapway 440. As described above with respect to FIG. 1, the trapway may include a first portion, a second portion, and a weir separating the first and second portions. The first portion of the trapway 440 may extend from the sump 430 at an upwardly oblique angle to the weir. The second portion of the trapway may extend from the weir downwardly to an exiting device such as a drain pipe or soil pipe.

In some examples, the toilet 400 may further include a vent channel 450 extending from an inlet 451 at a top of the trapway 440 to an outlet 452 at the trapway 440 downstream of the gate valve 340. The vent channel 450 may further include a vent channel valve 460 configured to selectively allow a flow of fluid, for example, water and/or air, through the vent channel 450. In some examples, the vent channel valve 460 may be a solenoid valve. The vent channel 450 may be configured to vent air from the trapway upstream of the gate valve 340 to downstream of the gate valve 340 when the gate valve 340 is closed, allowing a portion to the trapway upstream of the gate valve to be filled (e.g., pre-primed) with water. In addition to venting the trapway 440, the vent channel 450 may provide overflow protection when the gate valve 340 is closed. Specifically, water in the trapway may flow into the inlet 451 of the vent channel 450 disposed at a top of the trapway 440 when a water level in the toilet (e.g., the bowl 420) is above the inlet 451. Water flowing into the vent channel may flow to the outlet 452, downstream of the gate valve 340, preventing the toilet 400 from overflowing. In some examples, the vent channel valve 460 may be open when the gate valve 340 is closed allowing the vent channel 450 to vent air downstream of the gave valve 340 and providing overflow protection. In some examples, the vent channel valve may be closed when the gate valve 340 is open.

In some examples, the toilet 400 may include an additional water feed (e.g., water supply line) into the trapway 440. The additional water feed may advantageously allow the filling of the trapway 440 to be separated from the filling of the bowl 420. For example, the trapway 440 and bowl 420 may be filled with or from different water sources. For example, a separate (e.g., first) source of water (e.g., grey water) may be used to fill the trapway 440 and a second source of water (e.g., freshwater) may be used to fill the bowl 420 and complete actions (e.g., closing) of the gate valve 340. This may advantageously allow two volumes of water (e.g., grey water, freshwater) to be kept separate and prevent a user from seeing and or smelling grey water when it is used in an operational cycle of the toilet 400. In some examples, even when only a single water source is included, an additional or separate water feed to the trapway 440 may advantageously provide more precise control over the flushing system and required volumes of water.

In some examples, the toilet 400 and/or flush engine 300 may further include a controller 800 connected to and/or in communication with the first valve 320, the second valve 330, and the vent channel valve 460. The controller 800 may be configured to send control signals and/or electric current to the first valve 320, second valve 330, and/or vent channel valve 460 causing the first valve 320, second valve 330, and/or vent channel valve 460 to open or close.

In some examples, the toilet 400 and/or flush engine 300 may further include a power supply 470 connected to the first valve 320, second valve 330, vent channel valve 460, and controller 800. The power supply 470 may be configured to provide power (e.g., electric current) to the first valve 320, second valve 330, vent channel valve 460, and controller 800. In some examples, the power supply 470 may be a battery pack including one or more batteries (e.g., disposable, rechargeable). In other examples, the power supply 470 include a plug and/or wall outlet.

In some examples, the gate valve 340 may not be operated by a hydraulic cylinder in instead the flush engine 300 and/or toilet 400 may include a pair of solenoids configured to actuate the gate valve 340 (e.g., between open and closed positions). The pair of solenoids actuating the gate valve 340 may allow the gate valve to open or close independently of water being supplied to the rim outlet 350 and the sump jet outlet 360 (e.g., independently of the first valve 320 and second valve 330). For example, allowing the gate valve 340 to open, starting a siphon, a predetermined period of time before water is dispensed from the sump jet outlet 360.

Figure 8:
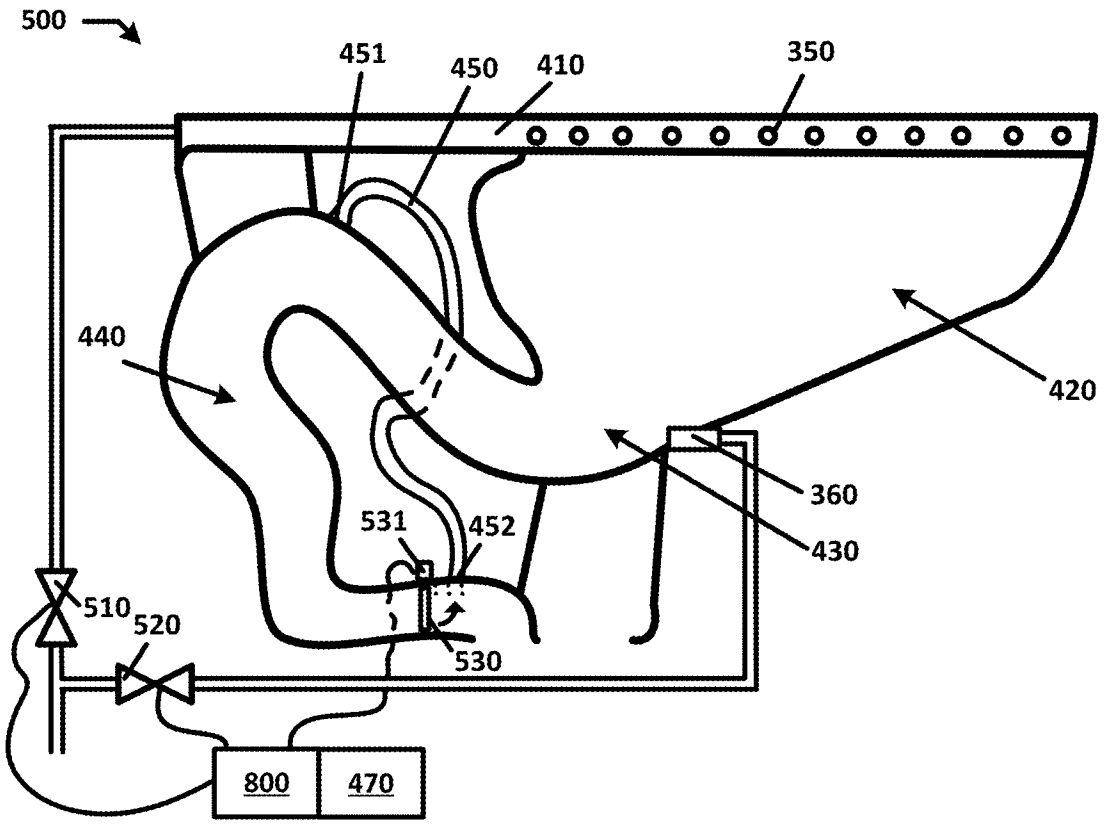
FIG. 8 illustrates a toilet in accordance with another example of the present disclosure.

Referring to FIG. 8, a toilet 500 according to one example of the present disclosure is illustrated. As illustrated in FIG. 8, the toilet includes a rim channel 410, rim outlet 350, bowl 420, sump 430, sump jet outlet 360, trapway 440, and vent channel 450. In some examples, the toilet 500 may further include controller 800 and power supply 470.

As illustrated in FIG. 8, the toilet 500 further includes a first valve 510 configured to selectively provide a flow of water to the rim outlet 350. The toilet 500 may further include a second valve 520 configured to supply a flow of water to the sump jet outlet 360. In some examples, the first valve 510 and the second valve 520 may be solenoid valves.

The toilet 500 further includes gate valve 530. The gate valve 530 may be disposed in the trapway 440. Specifically, in some examples, the gate valve 530 may be disposed in a horizontal or substantially horizontal leg of the trapway. In some examples, the gate valve 530 may be a flapper door configured to move (e.g., pivot) between an open position in which the gate valve 530 does not block the trapway 440 and a closed position, as illustrated in FIG. 8, in which the gate valve 530 blocks the trapway 440. Specifically, the gate valve 530 may include a flapper configured to rotate a predetermined angle about a pivot between the open and closed positions. The flapper may seal off the trapway 440 when it is in the closed position. For example, the flapper may have the same size and/or shape as the trapway (e.g., circular, oblong) so as to sealing engage the trapway (e.g., an interior surface of the trapway 440) in the closed position, preventing water and/or waste from traveling through the trapway 440. In some examples, the toilet 500 may include an actuator 531 configured to open and/or close the gate valve 530. For example, the actuator 531 may be a linear actuator configured to move a pin to hold the gate valve 530 closed, a servo motor to rotate the gate valve 530, or a servo motor winding a spring configured to move the gate valve 530. Additionally, in some examples, the gate valve 530 may include a manual control configured to open and/or close the gate valve.

In some examples, the actuator 531 may be a hydraulic cylinder (e.g., 140) configured to open and/or close the gate valve 530. Specifically, the hydraulic cylinder 140 cause a flapper door to rotate or pivot between an open and a closed position. In some examples, as described above, when water is provided to a rim outlet 350 the hydraulic cylinder (e.g., 140) may cause the flapper door of the gate valve 530 to be moved to or remain in an open position and when water is provided to a sump outlet 360 the hydraulic cylinder (e.g., 140) may cause the flapper door of the gate valve 530 to be moved to or to remain in a closed position.

In addition to selectively blocking the trapway 440, the gate valve 530 may selectively block or closed the vent channel 450. Specifically, the gate valve 530 may rotates so as to block or close the vent channel 450 when the trapway 440 is open or unobstructed and the gate valve 530 may rotate so as to open the vent channel 450 when the trapway 440 is closed.

Accordingly, the toilet 500 may advantageously allow the gate valve 530 to operate independently, of water being supplied to the rim outlet 350 and the sump jet outlet 360 (e.g., independently of the first valve 510 and second valve 520). For example, allowing the gate valve 530 to open, starting a siphon, a predetermined period of time before water is dispensed from the sump jet outlet 360. However, as noted above, in some examples, a hydraulic cylinder (e.g., 140) may still be used with a gate valve 530 including a flapper door such that the gate valve 530 opens and closes as water is supplied to the rim outlet 350 and sump outlet 360, respectively.

The controller 800 may be configured to send control signals and/or electric current to the first valve 510, the second valve 520, and the actuator 531 to open and/or close the first valve 510, second valve 520, and gate valve 530, respectively. The power supply may be connected to and configured to supply power to the controller 800, first valve 510, second valve 520, and actuator 531.

Figure 9:
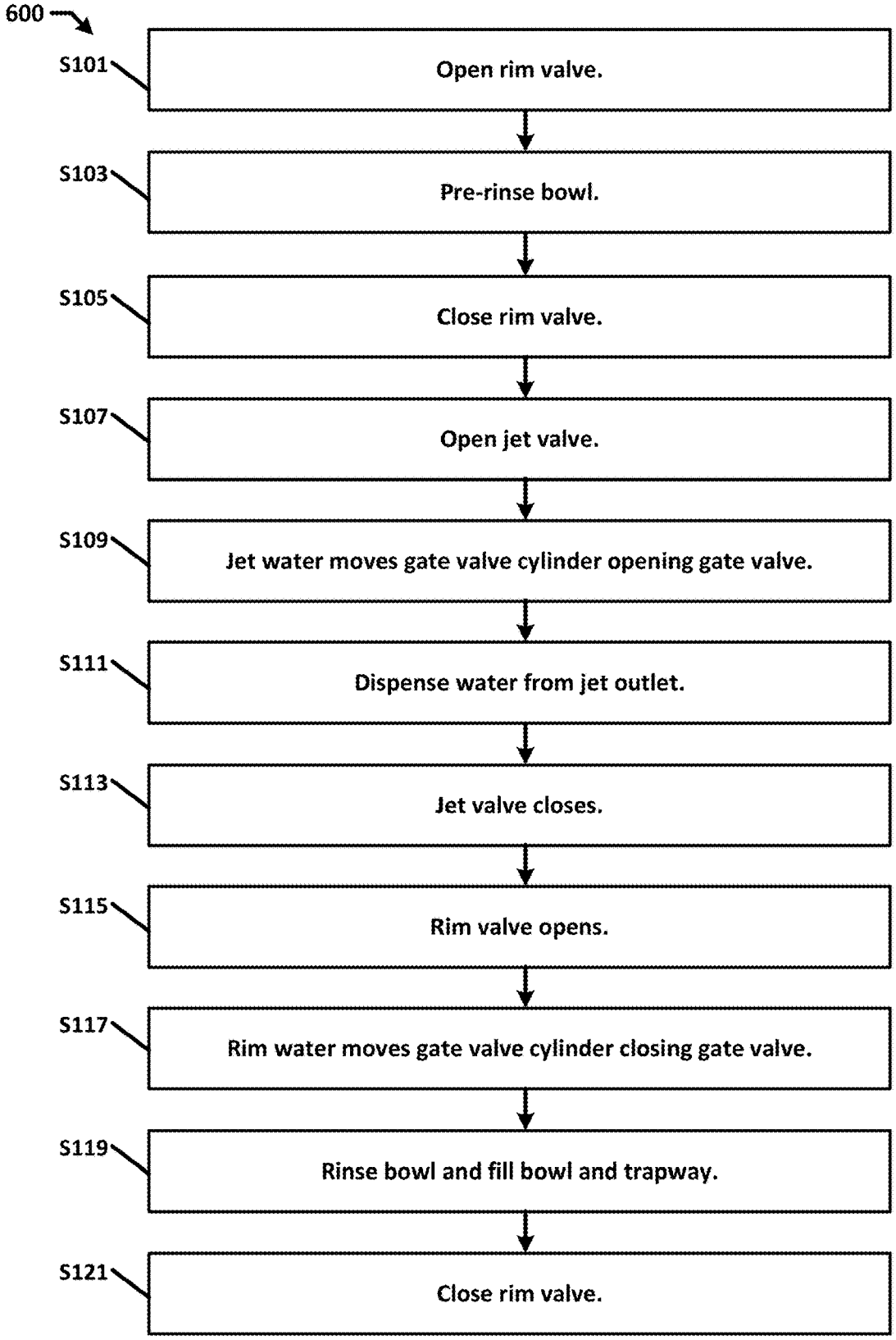
FIG. 9 illustrates a flow chart for an operational cycle of a toilet in accordance with one example of the present disclosure.

Referring to FIG. 9, a flow chart 600 for an operational cycle of a toilet in accordance with one example of the present disclosure is illustrated. The flow chart 600 may be used with any of the flush engine 300, the toilet 400, or the toilet 500. For ease of explanation, the flow chart 600 is described below with respect to the toilet 400. Additional, different, or fewer acts may be provided.

In a first act S101, a first valve 320 (e.g., rim valve) is opened. As described above with respect to FIGS. 5-7, the first valve 320 may be configured to selectively provide a flow of fluid (e.g., water) from a fluid supply to a first end (e.g., 242) of a hydraulic cylinder (e.g., 240) included in the gate valve 340 and to the rim outlet 350. In some examples, the first valve 320 may be a solenoid valve and may be opened in response to a control signal and/or electric current provided via the controller 800. The gate valve 340 may be in a closed position during act S101 and a flow of fluid into the hydraulic cylinder may maintain a closed position of the gate valve 340.

In a second act S103, a flow of water (e.g., conveyed through the first valve 320) pre-rinses the bowl 420 of the toilet 400. Specifically, a flow of water may be provided through the first valve 320 to a rim outlet 350 of the toilet 400. The flow of water may flow through the rim outlet 350 into the bowl 420, rinsing (e.g., pre-rinsing) the bowl 420.

In a third act S105, the first valve 320 (e.g., rim valve) is closed. In some examples, the first valve 320 may be closed in response to a control signal and/or electric current provided via the controller 800. In some examples, the controller 800 may be configured to close the first valve 320 a predetermined period of time after the first valve 320 is opened. The predetermined period of time may correspond to a desired volume of water used to pre-rinse the bowl 420.

In a fourth act S107, the second valve 330 (e.g., sump jet valve) is opened. As described above, with respect to FIGS. 5-7, the second valve 330 may be configured to selectively provide a flow of fluid (e.g., water) from a fluid supply to a second end (e.g., 243) of a hydraulic cylinder (e.g., 240) included in the gate valve 340 and to the sump jet outlet 360. In some examples, the second valve 330 may be a solenoid valve and may be opened in response to a control signal and/or electric current provided via the controller 800.

In a fifth act S109, the gate valve 340 is opened using the hydraulic cylinder (e.g., 240). Specifically, a flow of water (e.g., conveyed through the second valve 330) flows into a second end (e.g., 243) of the hydraulic cylinder moving a piston (e.g., 241) to a first end (e.g., 242) of the hydraulic cylinder. As the piston moves the first end one or more linkages (e.g., 250) may cause the gate (e.g., 230) to move to an open position. For example, the gate (e.g., 230) may slide within a housing (e.g., 210) between the open and closed positions. In some examples, as the gate valve 340 opens, water disposed in the trapway may flow through the gate valve 340 creating a siphon in the toilet 400.

In a sixth act S111, a flow of water (e.g., conveyed through the second valve 330) is dispensed through the sump jet outlet 360. Specifically, a flow of water may be provided through the second valve 330 to a sump jet outlet 360 disposed in the sump 430. The water may flow through the sump jet outlet 360 into the sump 430 of the toilet.

In a seventh act S113, the second valve 330 (e.g., sump jet valve) is closed. In some examples, the second valve 330 may be closed in response to a control signal and/or electric current provided via the controller 800. In some examples, the controller 800 may be configured to close the second valve 330 a predetermined period of time after the second valve 330 is opened. The predetermined period of time may correspond to a desired volume of water to be dispensed through the sump jet outlet 360.

In an eighth act S115, the first valve 320 (e.g., rim valve) is opened. As described above with respect to FIGS. 5-7, the first valve 320 may be configured to selectively provide a flow of fluid (e.g., water) from a fluid supply to a first end (e.g., 242) of a hydraulic cylinder (e.g., 240) included in the gate valve 340 and to the rim outlet 350. In some examples, the first valve 320 may be opened in response to a control signal and/or electric current provided via the controller 800.

In a ninth act S117, the gate valve 340 is closed using the hydraulic cylinder (e.g., 240). Specifically, a flow of water (e.g., conveyed through the first valve 320) flows into the first end (e.g., 242) of the hydraulic cylinder moving a piston 241 to the second end (e.g., 243) of the hydraulic cylinder. As the piston moves to the second end one or more linkages (e.g., 250) may cause the gate (e.g., 230) to move to a closed position.

In a tenth act S119, the bowl 420 is rinsed and the bowl 420 and trapway 440 are filled with water. Specifically, a flow of water (e.g., conveyed through the first valve 320) provided to the bowl 420 through the rim outlet 350 rinses the bowl and fills the bowl 420 and the trapway 440 with water. The gate valve 340 may be closed during act S119, preventing water provided via the rim outlet 350 from flowing through the trapway 440. In some examples, the trapway 440 may be completely filled with water, pre-priming the trapway for a subsequent operational cycle.

In an eleventh act, S121, the first valve 320 (e.g., rim valve) is closed. In some examples, the first valve 320 may be closed in response to a control signal and/or electric current provided via the controller 800. In some examples, the controller 800 may be configured to close the first valve 320 a predetermined period of time after the first valve 320 is opened. The predetermined period of time may correspond to a desired or required volume of water to completely fill the trapway, pre-priming the toilet for a subsequent operational cycle.

In some examples, the flow chart 600 may further include opening a vent channel valve 460. For example, the vent channel valve may be opened before or when the gate valve 340 is closed. Specifically, the vent channel valve 460 may maintain the vent channel 450 in an open position as the bowl 420 and trapway 440 are filled with water provided through the rim outlet 350. Maintaining the vent channel 450 in open state may allow air to be vented from the trapway upstream of the gate valve 340 to the trapway downstream of the gate valve 340 and prevent the toilet 400 from overflowing while the bowl 420 and trapway 440 are filled with water. In some examples, the flow chart 600 may further include closing the vent channel valve 460. In some examples, the vent channel valve 460 may be closed after the bowl 420 and trapway 440 are filled with water. In other examples, the vent channel 460 may be closed before the bowl 420 and the trapway 440 are filled with water. For example, the vent channel 460 may be closed after a predetermined volume of water has entered the trapway 440 and while the bowl 420 is still filling, preventing additional water from entering the trapway 440 and allowing for a partial fill of the trapway 440. This may advantageously allow for the use of less water during an operational (e.g., flush) cycle.

Figure 10:
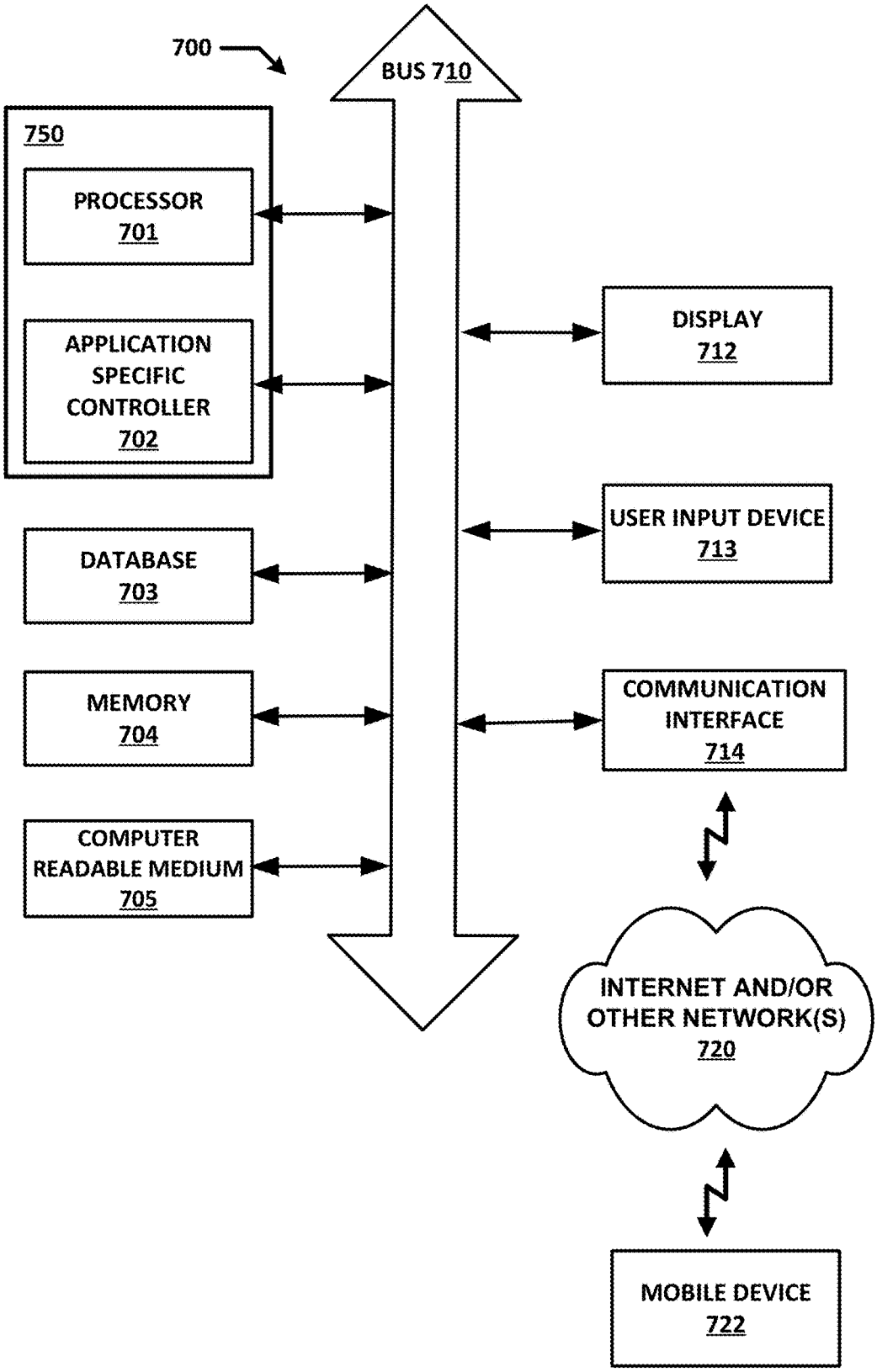
FIG. 10 illustrates an apparatus for in accordance with one example of the present disclosure.

Referring to FIG. 10, an apparatus 700 for facilitating an operational (e.g., flush) cycle of a toilet (e.g., 400, 500) in accordance with one example of the present disclosure. The apparatus 700 includes a bus 710 facilitating communication between a controller 750 that may be implemented by a processor 701 and/or application specific controller 702 and one or more components including a database 703, a memory 704, a computer readable medium 705, display 712, a user input device 713, and a communication interface 714.

The contents of the database 703 may include one or more volumes of water for example, a volume of water to pre-rinse the bowl 420, a volume of water dispensed from a sump jet outlet 360 during an operational cycle, and/or a volume of water required to fill the bowl 420 and trapway 440. The database may store volumes of water, flow rates (e.g., through rim outlet 350, sump jet outlet 360) and/or predetermined periods of time corresponding (e.g., required to provide) volumes of water. In some examples, the database 703 may store an equation or equations for calculating a volume, flow rate, or time period relating to water dispensed and/or conveyed through the first valve 320 and second valve 330.

The memory 704 may be a volatile memory or a non-volatile memory. The memory 704 may include one or more read only memory (ROM), random access memory (RAM), a flash memory, an electronic erasable program read only memory (EEPROM), or other type of memory. The memory 704 may be removable from the apparatus 700, such as a secure digital (SD) memory card.

The memory 704 and/or the computer readable medium 705 may include a set of instructions that can be executed to cause the controller to perform any one or more of the methods or computer-based functions disclosed herein. For example, the controller 750 may send one or more controller signals and/or electric current to the first valve 320, second valve 330, and vent channel valve 460 opening and/or closing the valves (i.e., such that the flush engine 300 and/or toilet 400 performs the flow chart 600).

A user may initiate an operational cycle, input one or more volumes, and/or input one or more time periods relevant to an operational cycle using the display 712 and/or user input device 713. The display 712 may comprise a screen and the user input device 713 may comprise one or more buttons on the apparatus 700. In some embodiments, the display 712 and user input device 713 may comprise a touch sensitive surface (i.e., a touch screen). In some examples, the user input device may be an actuator as described above with respect to FIG. 1.

The communication interface 714 may be connected to the network 720, which may be the internet. In some embodiments, the network 720 may be connected to one or more mobile devices 722. The one or more mobile devices may be configured to send a signal to the communication interface 714 via the network 720. For example, a more mobile devices may send a signal to the communication interface to initiate an operational cycle of the toilet 400 or change one or more volumes of water and/or time periods (e.g., predetermined time periods) associated with an operation cycle of the toilet.

The communication interface 714 may include any operable connection. An operable connection may be one in which signals, physical connections and/or logical communications may be sent and/or received. An operable connection may include a physical interface, an electrical interface, and/or a data interface. The communication interface 714 provides for wireless and/or wired communications in any known or later developed format.

Figure 12:
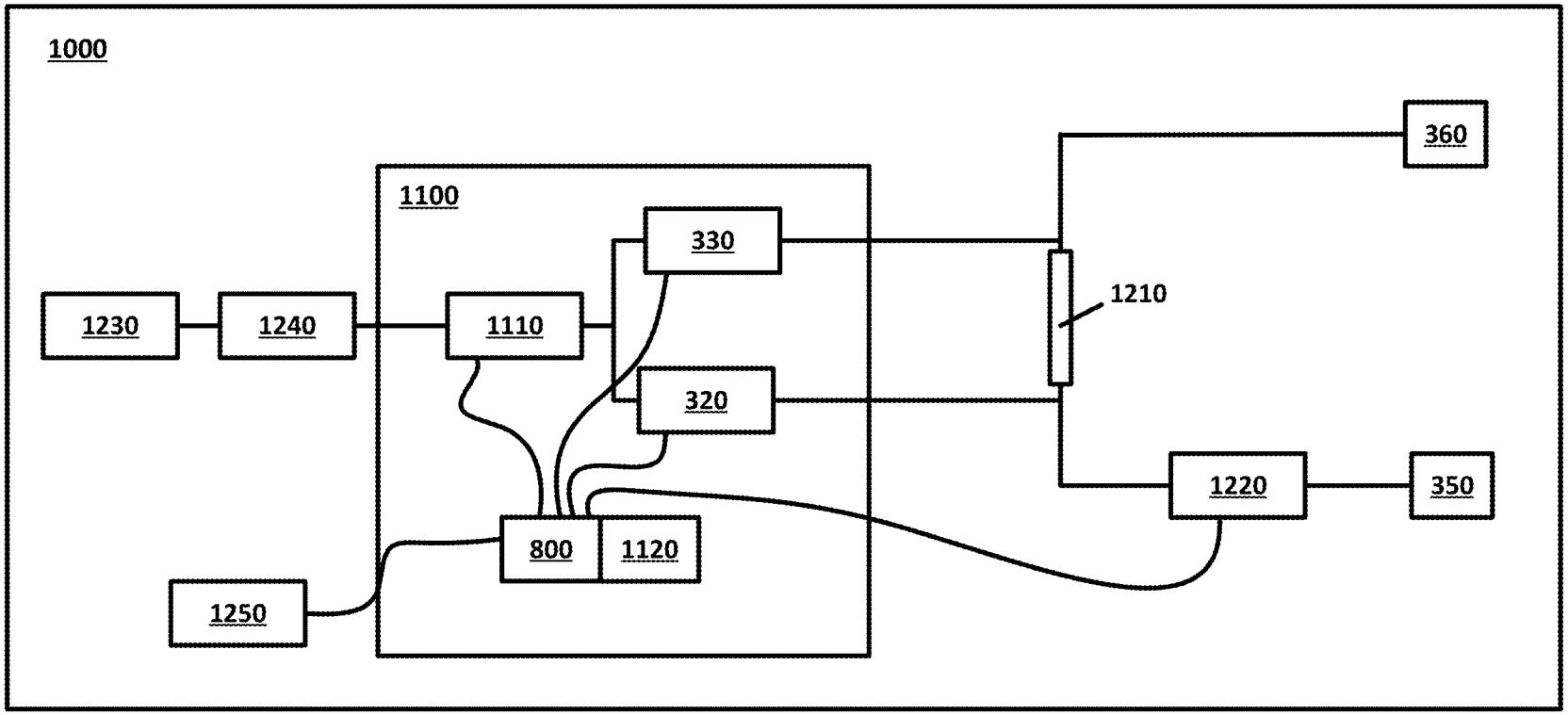
FIG. 12 illustrates a system for flushing a toilet in accordance with one example of the present disclosure.

Referring to FIG. 12, a system 1000 for flushing a toilet is illustrated in accordance with one example of the present disclosure. As shown in FIG. 12, the system 1000 includes a flow controller 1100, a gate valve 1210, an auxiliary valve 1220, a flow regulator 1230, a backflow prevention device 1240, and an actuator 1250. The system 1000 for flushing a toilet may be configured to selectively open a gate valve 1210 disposed in a trapway of a toilet, convey a flow of water through a rim outlet 350, and convey a flow of water through a sump jet outlet 360. The gate valve 1210 may be the same or substantially similar to any of the gate valves 100, 200, 340, 1300 described herein.

Figure 13:
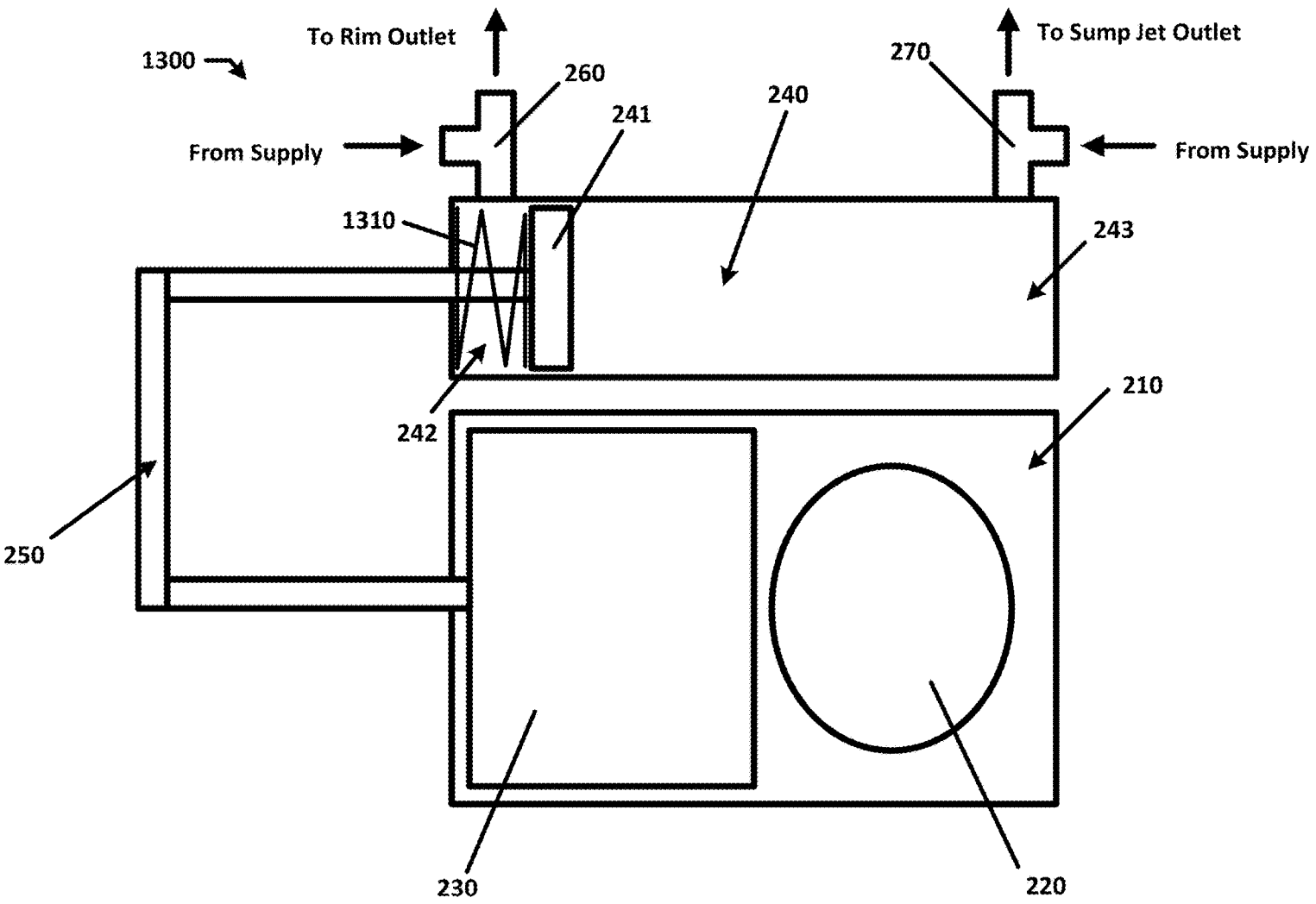
FIG. 13 illustrates a gate valve in accordance with yet another example of the present disclosure.

As illustrated in FIG. 12, the flow controller 1100 may include a hydraulic turbine 1110, a battery 1120, a rim valve or first valve 320, a jet valve or second valve 330, and a controller 800. In accordance with some examples of the present disclosure, various components comprising the flow controller 1100 may be disposed within a housing 1150 (See FIG. 13). Specifically, the hydraulic turbine 1110, battery 1120, rim valve or first valve 320, jet valve or second valve 330, and/or controller 800 may all be disposed within the housing 1150. As shown in FIG. 13, the housing 1150 may include an inlet 1151 configured to receive a flow of water from a water supply, a first outlet 1152 in fluid communication with a first side or first inlet of the hydraulic cylinder and a rim outlet 350, and a second outlet 1153 in fluid communication with a second side or second inlet of the hydraulic cylinder and a sump jet outlet 360.

Referring to FIG. 12, the flow controller 1100 may include a rim valve or first valve 320 and a jet valve or second valve 330. The first valve 320 and the second valve 330 may be the same as those described above with respect to FIGS. 5 and 6. Specifically, the rim valve or first valve 320 may control a flow of water (e.g., second flow of water) provided to the first outlet 1152, the first end or first side of the hydraulic cylinder, and the rim outlet 350 (when the auxiliary valve 1220 is open). Similarly, the jet valve or second valve 330 may control a flow of water (e.g., third flow of water) provided to the second outlet 1153, second end or second side of the hydraulic cylinder, and the sum jet outlet 360. In some examples, the first valve 320 and the second valve 330 may be solenoid valves. In some examples, the first valve 320 and the second valve 330 may be binary valves; for example, the first valve 320 and the second valve 330 may be configured to actuate between two positions, a completely open position, and a completely closed position. In other examples, the first valve 320 and the second valve 330 may be operable to open to various intermediate positions in addition to a the completely open and completely closed positions.

As illustrated in FIG. 12, in some examples, the flow controller 1100 may include a hydraulic turbine 1110. The hydraulic turbine 1110 may be configured to generate power (i.e., electric current) as fluid flows past the hydraulic turbine 1110. Specifically, the hydraulic turbine 1110 may include an impeller disposed in a pathway or conduit through which fluid (e.g., water) flows. As water flows through the pathway or conduit in which the impeller is disposed, water may contact the impeller, causing the impeller to rotate. The hydraulic turbine 1110 may include one or more magnets and one or more coils configured to generate power as fluid flows passed the impeller, rotating the impeller.

The hydraulic turbine 1110 may be in fluid communication with and receive a flow of water from the water supply. The hydraulic turbine 1110 may also be in fluid communication with the rim valve or first valve 320 and the jet valve or second valve 330. In some examples, the hydraulic turbine 1110 may be disposed upstream of first valve 320 and the second valve 330. Accordingly, in some examples, a flow of water from the water supply may travel through the hydraulic turbine 1110 before traveling to the first valve 320 and the second valve 330. In some examples, after traveling through the hydraulic turbine 1110, the flow of water may be split so as to be provided to the first valve 320 and the second valve 330 in parallel.

According to some examples of the present disclosure, the hydraulic turbine 1110 may be disposed in the housing 1150. For example, the hydraulic turbine 1110 may be disposed along a pathway or conduit in fluid communication with the inlet 1151, such that the hydraulic turbine 1110 receives a flow of water (e.g., first flow of water) provided to the inlet 1151. After flowing through the hydraulic turbine 1110 the flow of water (e.g., first flow of water) may be provided to the first valve 320 and the second valve 330 in parallel. Specifically, the flow of water (e.g., first flow of water) may be split such that a first portion of the flow of water is provided to the first valve 320 and a second portion of the flow of water is provided to the second valve 330. In some examples, half of the flow of water (e.g., first flow of water) may be provided to each of the first valve 320 and the second valve 330. According to the present disclosure, two or more pathways, conduits, hoses, or the like disposed between the hydraulic turbine 1110 and the first and second valves 320, 330 may split the flow of water (e.g., first flow of water) such that the flow of water is provided to the first valve 320 and the second valve 330 in parallel.

In accordance with other examples of the present disclosure, the hydraulic turbine 1110 may be disposed outside of the housing 1150; for example, the hydraulic turbine 1110 may be disposed upstream of the housing 1150 between a water supply and the housing 1150. In yet other examples, the hydraulic turbine 1110 may be disposed downstream of the first valve 320 or the second valve 330. The hydraulic turbine 1110 may be disposed downstream of the first valve 320 and the second valve 330 within the housing 1150 or outside of the housing 1150.

The hydraulic turbine 1110 may be electrically connected to the battery 1120 and/or controller 800. According to some examples, the battery 1120 and/or controller 800 may be disposed in the housing 1150. The battery 1120 may be configured to store power generated by the hydraulic turbine 1110. In some examples, power generated by the hydraulic turbine 1110 may travel through the controller 800 before being stored in the battery 1120. Additionally, the battery 1120 and/or controller 800 may be configured to provide power stored in the battery 1120 to one or more components of the system 1000 for flushing a toilet. Specifically, the battery 1120 and/or controller 800 may be connected to and configured to provide power to any of the first valve 320, second valve 330, auxiliary valve 1220, and the flow regulator 1230.

In accordance with various examples of the present disclosure, toilets 400 and 500 described above with respect to FIGS. 7 and 8 may further include a hydraulic turbine 1110 as described herein. Further, the power supply 470 as described above with respect to FIGS. 7 and 8 may be the battery 1120 as described herein.

The controller 800 may be connected to and/or in communication with the hydraulic turbine 1110, the battery 1120, the rim valve or first valve 320, and the jet valve or second valve 330. The controller 800 may be configured to provide one or more control signals and/or electric current to the first valve 320 and/or the second valve 330 causing the first valve 320 and or the second valve to actuate (e.g., open, close). The controller 800 may receive power (e.g., electric current) from the hydraulic turbine 1110 and/or the battery 1120.

Still referring to FIG. 12, in some examples, the system 1000 for flushing a toilet may further include an auxiliary valve 1220. The auxiliary valve 1220 may be disposed between the hydraulic cylinder and the rim outlet 350. Specifically, the auxiliary valve 1220 may be disposed along a pathway, conduit, tube, hose, or the like extending between a first end or first side of the hydraulic cylinder and the rim outlet 350. The auxiliary valve 1220 may be configured to actuate between a closed position in which a pathway between the hydraulic cylinder and the rim outlet 350 is blocked and an open position in which the pathway between the hydraulic cylinder and the rim outlet 350 is open (e.g., passable).

According to various examples of the present disclosure, the auxiliary valve 1220 may be selectively closed, such that when a flow of water is provided through the rim valve or first valve 320, the flow of water is forced to flow into the first end or first side of the hydraulic cylinder, moving the piston to a second end of the hydraulic cylinder, closing the gate valve 1210. In some examples, the auxiliary valve 1220 may be a solenoid valve. In some examples, the auxiliary valve 1220 may be a binary valve; for example, the auxiliary valve 1220 may be configured to actuate between two positions, a completely open position, and a completely closed position. In other examples, the auxiliary valve 1220 may be operable to open to various intermediate positions in addition to completely open and completely closed positions.

According to the present disclosure, the controller 800 may be connected to and/or in communication with the auxiliary valve 1220. The controller 800 may be configured to provide one or more control signals and/or electric current to the auxiliary valve 1220 causing the auxiliary valve 1220 to actuate (e.g., open, close). Additionally, the battery 1120 may be configured to provide power to the auxiliary valve 1220.

Figure 14:
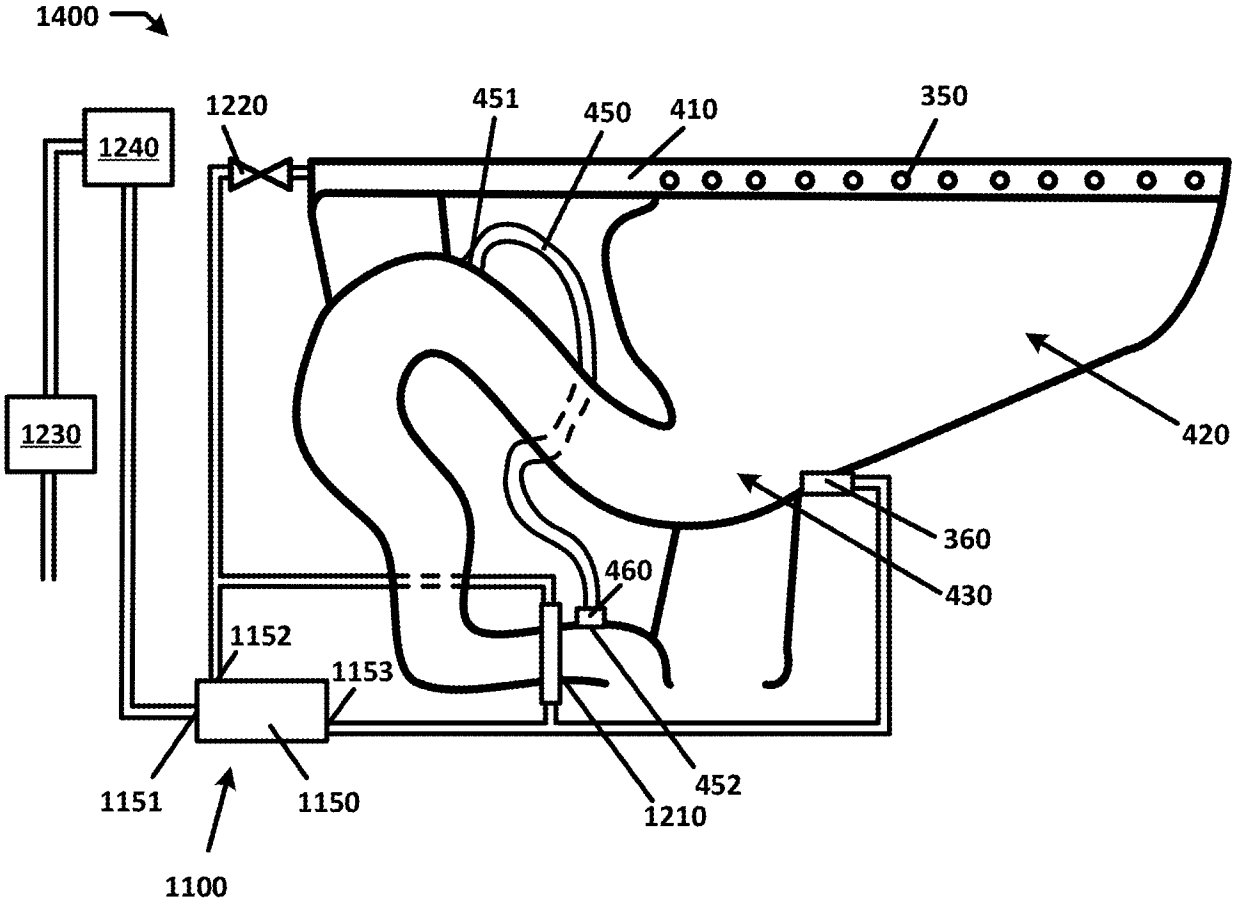
FIG. 14 illustrates a toilet in accordance with yet another example of the present disclosure.

Referring to FIG. 12, in some examples, the system 1000 for flushing a toilet may further include a flow regulator 1230. The flow regulator 1230 may be configured to accommodate for variations in water pressure of different plumbing installations. Specifically, the flow regulator 1230 may compensate for variations in water pressure, ensuring that a desired or predetermined volume of water is provided to the bowl of a toilet each time the rim valve or first valve 320 and the jet valve or second valve 330 are opened. In accordance with some examples, of the present disclosure, the flow regulator 1230 may be disposed upstream of the flow controller 1100. Specifically, the flow regulator 1230 may be disposed between the water supply and the flow controller 1100. In some examples, the flow regulator 1230 may be disposed at or near an inlet at which the system 1000 is connected to the water supply (e.g., building water distribution network). According to some examples, as shown in FIG. 14, the flow regulator 1230 may be disposed outside of the housing 1150. In other examples, the flow regulator 1230 may be disposed within the housing 1150.

According to some examples of the present disclosure, the flow regulator 1230 may be a pressure regulator including a pressure sensor configured to sense or detect the pressure of water supplied the flow controller 1100 (e.g., through inlet 1151). The pressure sensor may be in communication with the controller 800 and may provide sensor data (e.g., the sensed pressure) to the controller 800. The controller 800 may be configured to calculate a flow rate of water provided through the rim valve or first valve 320 and the jet valve or second valve 330 when the first valve 320 and the second valve 330 are open (e.g., fully open) using the sensed pressure and known characteristics of the flow controller 1100. Specifically, the controller 800 may calculate a flow rate provided through one of the first valve 320 or the second valve 330 using one or more of the sensed pressure; a flow area through the first valve 320 or the second valve 330 when the first valve 320 or second valve 330, respectively, are open; a reduction in pressure caused by the hydraulic turbine 1110; the shape, area, length, and/or a friction coefficient of conduit(s), pipe(s), or tube(s) extending between the flow regulator 1230 and the first valve 320 or second valve 330, respectively, and a reduction in pressure caused by a pathway or conduit network required to split the flow of water provided to the flow controller 1100, such that the flow of water is provided to the first valve 320 and the second valve 330 in parallel.

According to some examples of the present disclosure, only one of the first valve 320 and the second valve 330 may be open at once. Accordingly, in some examples, when the first valve 320 and the second valve 330 have the same have the same flow area and the pathways or conduit providing the flow of water to the first valve 320 and the second valve 330 are the same, a flow rate through the first valve 320 and the second valve 330, when the first valve 320 and the second valve 330, respectively, are open may be the same.

The controller 800 may be configured to adjust a duration or durations of time during which the first valve 320 and/or the second valve 330 are open based on the calculated flow rates through the first valve 320 and/or second valve 330. Specifically, the controller 800 may be configured to adjust a duration of durations of time during which the first valve 320 and/or the second valve 330 are open so that a desired or predetermined volume of water is provided to the bowl (e.g., through the rim outlet 350 or jet outlet 360, respectively) each time the rim valve or first valve 320 and/or jet valve or second valve 330 are opened.

According to some examples, of the present disclosure, the pressure regulator may sense the pressure of water supplied to the flow controller 1100 and the controller 800 may calculate a flow rate through the first valve 320 and/or the second valve 330 and adjust the duration or times for which the first valve 320 and/or second valve 330 are held open during each step or operation of the flush cycle periodically. For example, the pressure may be sensed, flow rates may be calculated, and timings may be adjusted at a regular interval, such as, hourly, at 12 hour intervals, daily, weekly, monthly, and the like.

In other examples of the present disclosure, the flow regulator 1230 may be a flow restrictor. The flow restrictor may be configured to reduce the pressure of water supplied to the flow controller 1100, such that a flow of water having a desired or predetermined flow rate is provided to the flow controller 1100. Specifically, the flow restrictor may be disposed between the water supply and the flow controller 1100 and may impede the flow of water provided to the flow controller by partially obstructing or blocking a pathway between the water supply and the flow controller 1100.

According to some examples, the flow restrictor may reduce the flow rate of water provided to the flow controller 1100 when the first valve 320 and/or the second valve 330 are opened, such that a flow rate of water supplied to the flow controller 1100 is uniform and constant. Accordingly, water having a constant flow rate may be provided to the flow controller when the first valve 320 and/or second valve 330 is opened such that a desired or predetermined volume of water may be dispensed to the bowl (e.g., through the rim outlet 350 and/or jet outlet 360, respectively) consistently, without having to adjust a duration or durations of time for which the first valve 320 and/or second valve 330 are help open.

Still referring to FIG. 12, in some examples, the system 1000 for flushing a toilet may further include a backflow prevention device 1240. The backflow prevention device 1240 may be in fluid communication with and disposed upstream of the flow controller 1100 (e.g., first valve 320, second valve 330). The backflow prevention device 1240 may be a one-way valve or device configured to allow a flow of fluid to travel therethrough in a first direction while preventing fluid from traveling therethrough in a second, opposite direction. Specifically, the backflow prevention device 1240 may allow fluid (e.g., water) from the water supply to flow through the backflow prevention device 1240 (e.g., to the flow controller 1100) while preventing fluid and/or waste from flowing backward through the system 1000 from the flow controller 1100 to the water supply. The backflow prevention device 1240 may be, for example, a vacuum breaker, a check valve, or the like.

Specifically, in some examples, the backflow prevention device may be an atmospheric vacuum breaker (AVB). The AVB may be configured to allow air to enter a pathway or conduit between the water supply and the flow controller 1100 if the pressure upstream of the AVB (i.e., between the AVB and the water supply) is equal to or less than atmospheric pressure. Specifically, the AVB may include a poppet valve, which during normal use is maintained in a closed position under the pressure of water provided by the water supply. However, if the pressure between the AVB and the water supply drops and is equal to or less than atmospheric pressure, the poppet valve moves to an open position, allowing air to flow into the pathway or conduit between the AVB and the flow controller 1100 and blocking a pathway or conduit between the AVB and the water supply. According to some examples of the present disclosure, if fluid downstream of the AVB flows through an air port (e.g., poppet valve) of the AVB during operation of the AVB, the flow traveling through the air ports may be contained and conveyed to a leakage port. In some examples, the backflow prevention device, specifically, an AVB may be disposed at or above an elevation of the highest outlet (e.g., rim outlet 350, jet outlet 360) included in the system 1000. Specifically, according to some examples of the present disclosure, the backflow prevention device 1240 may be disposed above a rim channel (e.g., 410) and/or the rim outlet 350.

Still referring to FIG. 12, in some examples, the system 1000 for flushing a toilet may further include an actuator 1250. The actuator 1250 may be connected to and/or in communication with the controller 800. The actuator 1250 may be configured provide one or more input signals to the controller 800 in response to actuation by the user. The one or more input signals may, for example, initiate one or more operational or flush cycles.

According to the present disclosure, the actuator 1250 may include on or more tactile (e.g., movable) buttons and/or one or more sensors, for example, capacitive sensors, configured to receive an input when the user is proximate to the sensor. According to some examples of the present disclosure, the actuator 1250 may be disposed on a skirt or shroud of the toilet. For example, the actuator 1250 may be disposed on the skirt of a toilet at a right or left side of the toilet.

Referring to FIG. 13, a gate valve 1300 is illustrated in accordance with one example of the present disclosure. The gate valve 1300 may be the same or substantially similar to the gate valve 200 described above with respect to FIG. 2, except the hydraulic cylinder 240 of the gate valve 1300 may further include an elastic member 1310 configured to bias or apply a force to the piston 241 toward the second end 243 of the hydraulic cylinder 240. Specifically, the elastic member 1310 may apply a force to the piston 241 toward an end of the hydraulic cylinder 240 corresponding to a closed position of the gate valve 1300, reducing the pressure and/or flow rate of water (e.g., supplied to the first side or first end 242 of the hydraulic cylinder 240) required to move the piston 241 to the second end 243 of the hydraulic cylinder 240, closing the gate valve 1300. In some examples, as illustrated in FIG. 13, the elastic member 1310 may be a spring.

Referring to FIG. 14, a toilet 1400 is illustrated in accordance with one example of the present disclosure. The toilet 1400 may include one or more components of the system 1000 for flushing a toilet described above with respect to FIG. 12. For example, the toilet 1400 may include the flow controller 1100, gate valve 1210, auxiliary valve 1220, rim outlet 350, jet outlet 360, flow regulator 1230, backflow prevention device 1240, and actuator 1250 described above with respect to FIG. 12.

As illustrated in FIG. 14, and noted above, in some examples, the flow controller 1100 may be disposed in a housing 1150. The housing 1150 may include an inlet 1151 configured to receive a flow of water (e.g., first flow of water) from the water supply. The housing 1150 may further include a first outlet 1152 in communication with the rim valve or first valve 320, a first side of the hydraulic cylinder, the auxiliary valve 1220, and the rim outlet 350 (e.g., when auxiliary valve 1220 is open). In accordance with some examples of the present disclosure, the first valve 320 may control a flow of water (e.g., second flow of water) provided to the first outlet 1152. The housing 1150 may further include a second outlet 1153 in communication with jet valve or second valve 330, a second side of the hydraulic cylinder, and the jet outlet 360. In accordance with some examples of the present disclosure, the second valve 330 may control a flow of water (e.g., third flow of water) provided to the second outlet 1153.

In some examples, the housing 1150 may be disposed within a shroud or skirt of the toilet 1400. In some examples, the housing 1150 may be disposed at the back of the toilet 1400, for example, behind a sump 430 of the toilet 1400. In some examples, the housing 1150 may be disposed at a bottom of the toilet 1400, for example, below a sump 430 of the toilet. According to some examples, of the present disclosure, the housing 1150 may be disposed at a back and a bottom of the toilet 1400. For example, the housing 1150 may be coupled to a base of the toilet 1400 configured to support the toilet 1400.

As described above, the flow controller 1100 and/or the housing 1150 may include a hydraulic turbine 1110, a rim valve or first valve 320, a jet valve or second valve 330, a controller 800, and a battery 1120.

As shown in FIG. 14, the toilet 1400 may further include a rim channel 410, a bowl 420, a sump 430, and a trapway 440. The rim channel 410, bowl 420, sump 430, and trapway 440 may all be the same as those described above with respect to FIGS. 7 and 8. In some examples, as shown in FIG. 14, the auxiliary valve 1220 may be located downstream of a first end of the hydraulic cylinder between the hydraulic cylinder and the rim channel 410. In some examples, as illustrated in FIG. 14, the backflow prevention device 1240 may be disposed above the rim channel 410 and/or the rim outlet 350.

As shown in FIG. 14, in some examples, the toilet 1400 may further include a vent channel 450 including an inlet 451 and an outlet 452 and a vent channel valve 460. The vent channel 450, inlet 451, outlet 452, and vent channel valve 460 may be the same as those described above with respect to FIGS. 7 and 8.

Figure 15:
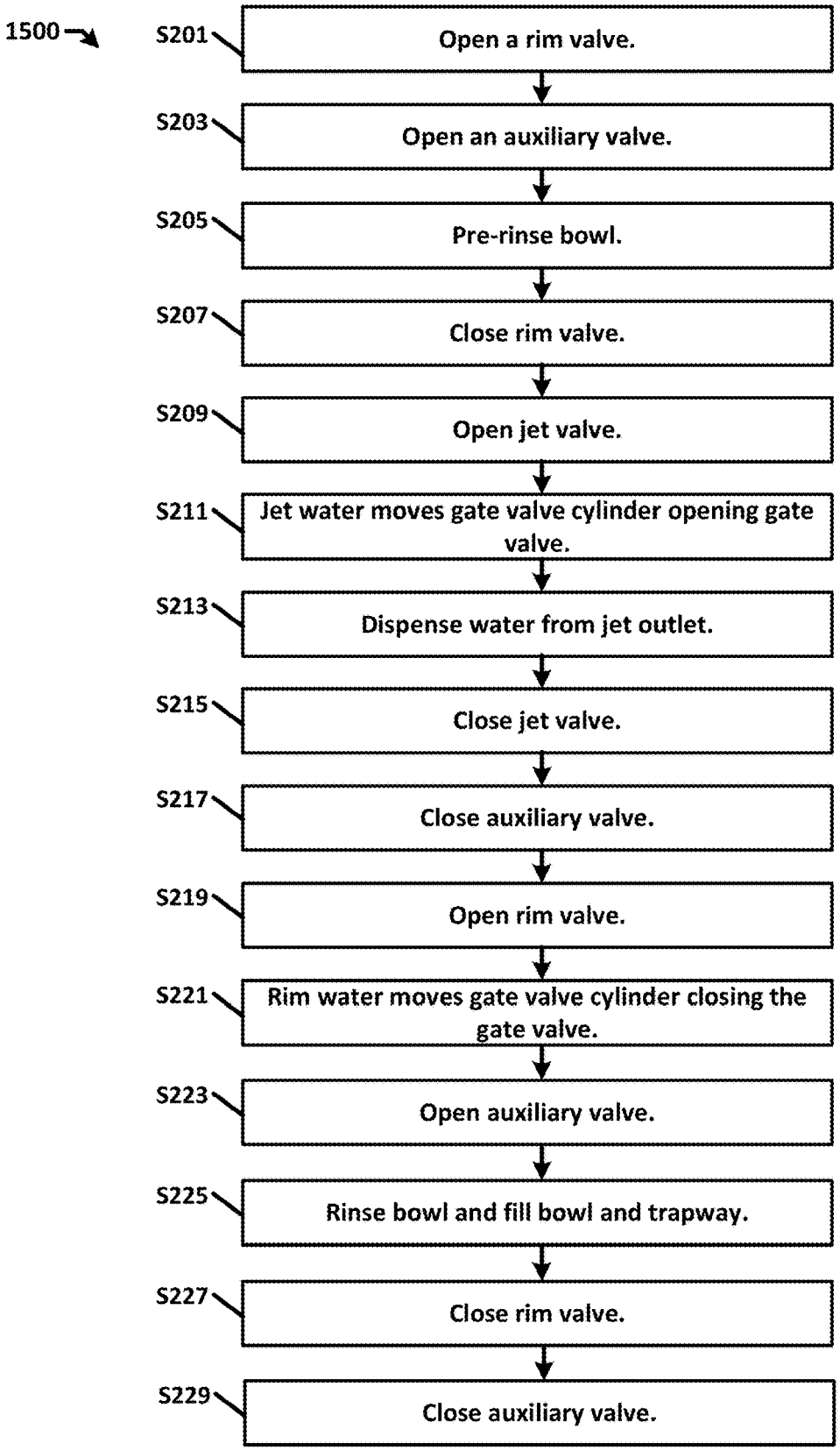
FIG. 15 illustrates a flow chart for an operational cycle of a toilet in accordance with another example of the present disclosure.

Referring to FIG. 15, a flow chart for an operational or flush cycle of a toilet is illustrated in accordance with one example of the present disclosure. The flow chart 1500 may be used in combination with any of the flush engine 300, toilet 400, toilet 500, system 1000 for flushing a toilet, or toilet 1400 described herein. For ease of explanation, the flow chart 1500 is described with respect to the toilet 1400. Additional, different, or fewer acts may be provided.

In a first act S201, a rim valve or first valve 320 is opened. As described above, with respect to FIGS. 5, 6, and 14, the first valve 320 may be configured to selectively provide a flow of fluid (e.g., water) from a fluid supply to a first end (e.g., 242) of a hydraulic cylinder (e.g., 240) included in the gate valve 1210. Additionally, the first valve 320 may selectively provide a flow of fluid from the water supply to the auxiliary valve 1220. In some examples, the first valve 320 may be a solenoid valve and may be opened in response to a control signal and/or electric current provided via the controller 800. The gate valve 1210 may be in a closed position during act S101 and a flow of fluid into the hydraulic cylinder may maintain a closed position of the gate valve 1210.

In a second act S203, the auxiliary valve 1220 is opened. As described above with respect to FIGS. 12 and 14, the auxiliary valve 1220 may be configured to control or selectively provide a flow of fluid to the rim line 410 and rim outlet 350. In some examples, the auxiliary valve 1220 may be a solenoid and may be opened in response to a control signal and/or electric current provided via the controller 800.

In a third act S205, a flow of water (e.g., conveyed through the first valve 320 and the auxiliary valve 1220) pre-rinses the bowl 420 of the toilet 400. Specifically, a flow of water may be provided through the first valve 320, through the auxiliary valve 1220, and through the rim channel 410 to a rim outlet 350 of the toilet 400. The flow of water may flow through the rim outlet 350 into the bowl 420, rinsing (e.g., pre-rinsing) the bowl 420.

In a fourth act S207, the first valve 320 (e.g., rim valve) is closed. In some examples, the first valve 320 may be closed in response to a control signal and/or electric current provided via the controller 800. In some examples, the controller 800 may be configured to close the first valve 320 a predetermined period of time after the first valve 320 is opened. The predetermined period of time may correspond to a desired volume of water used to pre-rinse the bowl 420. In some examples, the controller 800 may calculate a duration of time during which the first valve 320 is open based on a flow rate of water provided through the first valve 320 calculated using a pressure of water supplied to the flow controller 1100 sensed by the flow regulator 1230.

In a fifth act S209, a jet valve or second valve 330 is opened. As described above with respect to FIGS. 5, 6, and 14, the second valve 330 may be configured to selectively provide a flow of fluid (e.g., water) from a fluid supply to second end (e.g., 243) of a hydraulic cylinder (e.g., 240) included in the gate valve 1210 and to the sump jet outlet 360. In some examples, the second valve 330 may be a solenoid valve and may be opened in response to a control signal and/or electric current provided via the controller 800.

In a sixth act S211, the gate valve 1210 is opened using the hydraulic cylinder (e.g., 240). Specifically, a flow of water (e.g., conveyed through the second valve 330) flows into a second end (e.g., 243) of the hydraulic cylinder moving a piston (e.g., 241) to a first end (e.g., 242) of the hydraulic cylinder. As the piston moves to the first end (e.g., 242) one or more linkages (e.g., 250) may cause the gate (e.g., 230) to move to an open position. In some examples, as the gate valve 340 opens, water disposed in the trapway may flow through the gate valve 340 creating a siphon in the toilet 400.

In a seventh act S213, a flow of water (e.g., conveyed through the second valve 330) is dispensed through the sump jet outlet 360. Specifically, a flow of water may be provided through the second valve 330 to a sump jet outlet 360 disposed in the sump 430. The water may flow through the sump jet outlet 360 into the sump 430 of the toilet.

In an eight act S215, the second valve 330 (e.g., sump jet valve) is closed. In some examples, the second valve 330 may be closed in response to a control signal and/or electric current provided via the controller 800. In some examples, the controller 800 may be configured to close the second valve 330 a predetermined period of time after the second valve 330 is opened. The predetermined period of time may correspond to a desired volume of water to be dispensed through the sump jet outlet 360. In some examples, the controller 800 may calculate a duration of time during which the second valve 330 is open based on a flow rate of water provided through the second valve 330 calculated using a pressure of water supplied to the flow controller 1100 sensed by the flow regulator 1230.

In a ninth act S217, the auxiliary valve 1220 is closed. In some examples, the auxiliary valve 1220 may be a solenoid and may be closed in response to a control signal and/or electric current provided via the controller 800.

In a tenth act S219, the first valve 320 (e.g., rim valve) is opened. As described above with respect to FIGS. 5, 6, and 14, the first valve 320 may be configured to selectively provide a flow of fluid (e.g., water) from a fluid supply to a first end (e.g., 242) of a hydraulic cylinder (e.g., 240) included in the gate valve 340 and to the auxiliary valve 1220. In some examples, the first valve 320 may be opened in response to a control signal and/or electric current provided via the controller 800.

In an eleventh act S221, the gate valve 1210 is closed using the hydraulic cylinder (e.g., 240). Specifically, a flow of water (e.g., conveyed through the first valve 320) flows into the first end (e.g., 242) of the hydraulic cylinder moving a piston (e.g., 241) to the second end (e.g., 243) of the hydraulic cylinder. Specifically, because the auxiliary valve 1220 is closed during act S221, all of the water provided through the first valve 320 may be forced to flow into the hydraulic cylinder, moving the piston to the second end of the hydraulic cylinder. As the piston moves to the second end one or more linkages (e.g., 250) may cause the gate (e.g., 230) to move to a closed position.

In a twelfth act S223, the auxiliary valve 1220 may be opened. In some examples, the auxiliary valve 1220 may be a solenoid and may be opened in response to a control signal and/or electric current provided via the controller 800.

In a thirteenth act S225, the bowl 420 is rinsed and the bowl 420 and trapway 440 are filled with water. Specifically, a flow of water (e.g., conveyed through the first valve 320 and the auxiliary valve 122) is provided to the bowl 420 through the rim outlet 350 rinses the bowl and fills the bowl 420 and the trapway 440 with water. The gate valve 340 may be closed during act S119, preventing water provided via the rim outlet 350 from flowing through the trapway 440. In some examples, the trapway 440 may be completely filled with water, pre-priming the trapway for a subsequent operational cycle.

In a fourteenth act S227, the first valve 320 is closed. In some examples, the first valve 320 may be closed in response to a control signal and/or electric current provided via the controller 800. In some examples, the controller 800 may be configured to close the first valve 320 a predetermined period of time after the first valve 320 is opened. The predetermined period of time may correspond to a desired volume of water used to pre-rinse the bowl 420. In some examples, the controller 800 may calculate a duration of time during which the first valve 320 is open based on a flow rate of water provided through the first valve 320 calculated using a pressure of water supplied to the flow controller 1100 sensed by the flow regulator 1230.

In a fifteenth act S229, the auxiliary valve 1220 is closed. In some examples, the auxiliary valve 1220 may be a solenoid and may be closed in response to a control signal and/or electric current provided via the controller 800.

In some examples, the flow chart 1500 may further include acts for opening and/or closing a vent channel 460 as described above with respect to the flow chart 600 of FIG. 9.

In some examples, the apparatus 700 for facilitating a flush or operational cycle may be implemented as the controller 800. The apparatus 700 and/or controller may be configured to provide one or more control signals and/or power (e.g., electric current) to the first valve 320, second valve 330, and auxiliary valve 1220, for example, performing various acts of the flow chart 1500.

In some examples, the apparatus 700 for facilitating a flush or operational cycle and/or the controller 800 may include one or more back-up systems configured to initiate or perform the various steps of the flow charts 600 and/or 1500 in the event of an electronics failure. Specifically, the apparatus 700 and/or controller may include a button or buttons corresponding to each of the first valve 320, second valve 330, and auxiliary valve 1220, configured to override a control algorithm and directly provide a control signal and/or power to the corresponding valve, actuating the corresponding valve in the event of a partial electronics failure. According to some examples of the present disclosure, the button corresponding to each valve (e.g., first valve 320, second valve 330, auxiliary valve 1220) may be depressed, actuating or opening the corresponding valve and holding the corresponding valve in an open position until the button is released. Accordingly, an operational cycle as provided in flow charts 600 and/or 1500 may be performed by pressing and holding the buttons corresponding to each valve sequentially as provided in the flow charts 600 and 1500, respectively.

In accordance with some examples of the present disclosure the flush engine 300, toilets 400, 500, the system 1000, and/or the toilet 1400 may include a cord coupled to each of the first valve 320, the second valve 330, and/or the auxiliary valve 1220 configured to manually actuate (e.g., open) the corresponding valve when pulled. Accordingly, an operational cycle as provided in flow charts 600 and/or 1500 may be performed by pulling and holding the cords corresponding to each valve sequentially as provided in the flow charts 600 and 1500, respectively.

Figure 16:
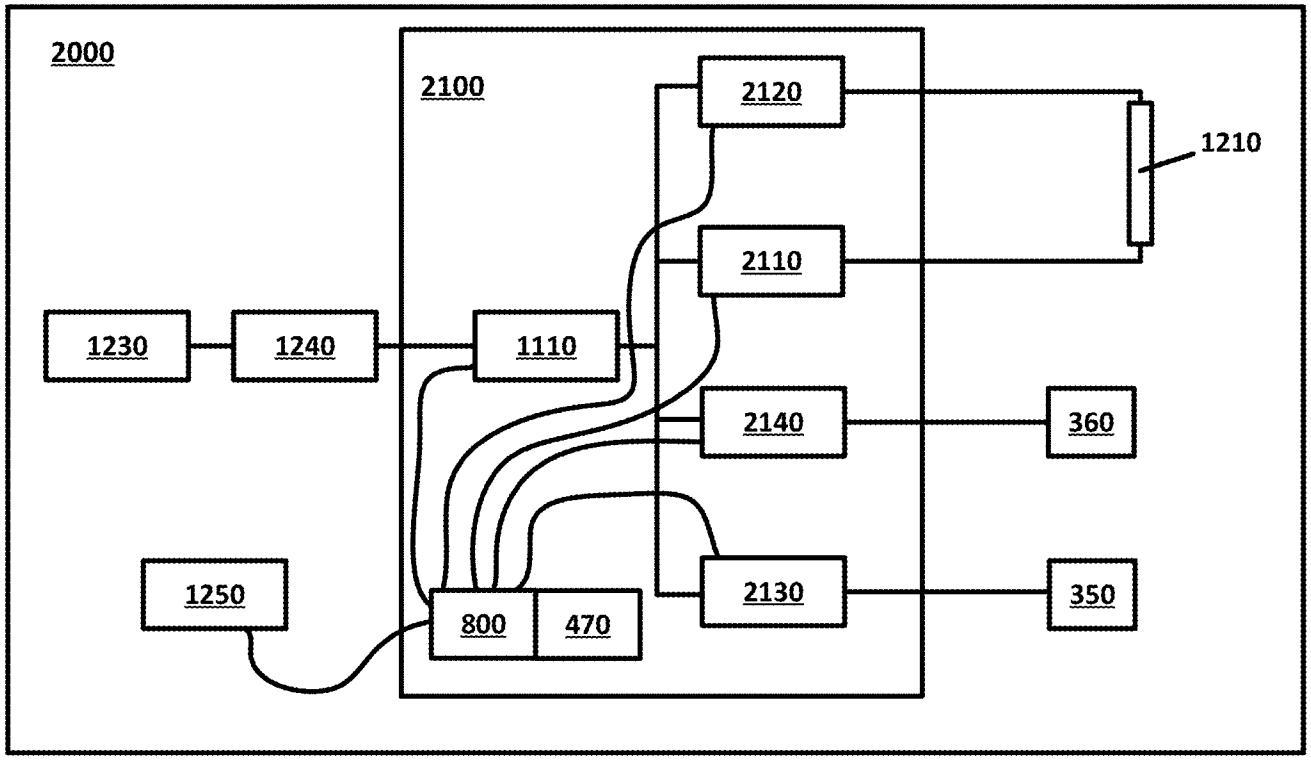
FIG. 16 illustrates a system for flushing a toilet in accordance with another example of the present disclosure.

Referring to FIG. 16, a system 2000 for flushing a toilet is illustrated in accordance with one example of the present disclosure. The system 2000 may be substantially similar to the system 1000 described above with respect to FIG. 12; however, the flow controller 2100 included in the system 2000 may include four valves, each of which is configured to selectively and independently provide a flow of fluid to one of the first end (e.g., 242) of the hydraulic cylinder (e.g., 240), the second end (e.g., 243) of the hydraulic cylinder, the rim outlet 350, and the jet outlet 360. Accordingly, as illustrated in FIG. 16, a flow of fluid (e.g., water) may be provided to the first end (e.g., 242) and the second end (e.g., 243) of the hydraulic cylinder (e.g., 240) independently of the rim outlet 350 and the jet outlet 360, respectively. Specifically, according to the system 2000 for flushing a toilet, a flow of fluid may be provided to the first or second end of the hydraulic cylinder, opening or closing the gate valve 1210 independently of fluid being provided to the rim outlet 350 and the jet outlet 360.

As shown in FIG. 16, the flow controller 2100 may include a closing valve 2110 configured to selectively provide a flow of fluid to a first end (e.g., 242) of the hydraulic cylinder (e.g., 240), the flow of fluid provided to the first end of the hydraulic cylinder configured to close the gate valve 1210. Further, the flow controller 2100 may include an opening valve 2120 configured to selectively provide a flow of fluid to a second end (e.g., 243) of the hydraulic cylinder (e.g., 240), the flow fluid provided to the second end of the hydraulic cylinder configured to open the gate valve 1210. Additionally, the flow controller 2100 may include an independent rim valve 2130 configured to selectively provide a flow of fluid to the rim outlet 350 and an independent jet valve 2140 configured to selectively provide a flow of fluid to the jet outlet 360. Additionally, the system 2000 for flushing a toilet may omit the auxiliary valve 1220 included in the system 1000 described above with respect to FIG. 12.

Each of the closing valve 2110, opening valve 2120, independent rim valve 2130, and/or independent jet valve 2140 may be solenoid valve. Further, each of the closing valve 2110, opening valve 2120, independent rim valve 2130, and/or independent jet valve 2140 may be connected to and/or in communication with the controller 800. The controller 800 may be configured to provide control signals and/or power to one or more of the closing valve 2110, opening valve 2120, independent rim valve 2130, and/or independent jet valve 2140, actuating (e.g., opening, closing) the respective valve. The battery 1120 may be connected to and configured to provide power to the closing valve 2110, the opening valve 2120, the independent rim valve 2130, and/or the independent jet valve 2140.

The hydraulic turbine 1110, flow regulator 1230, and backflow prevention device 1240 may be the same as described above with respect to FIG. 12. The controller 800 may calculate a flow rate through the independent rim valve 2130 and/or the independent jet valve 2140 and durations which the independent rim valve 2130 and the independent jet valve 2140 using a pressure sensed by the flow regulator 1230 and known characteristics of the system 2000.

Figure 17:
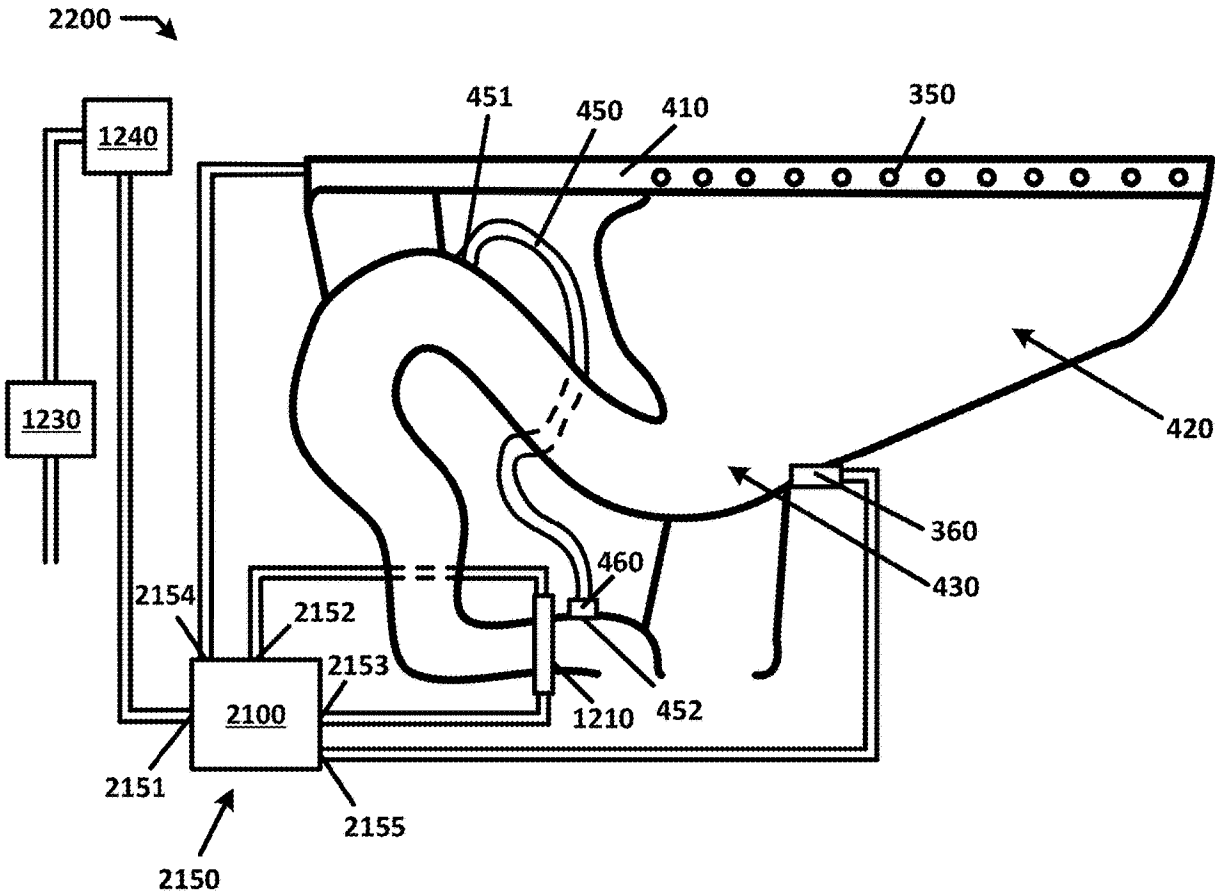
FIG. 17 illustrates a toilet in accordance with yet another example of the present disclosure.

Referring to FIG. 17, a toilet 2200 is illustrated in accordance with one example of the present disclosure. The toilet 2200 may include one or more components of the system 2000 for flushing a toilet described above with respect to FIG. 16. For example, the system 2000 for flushing a toilet may include a flow controller 2100, gate valve 1210, rim outlet 350, jet outlet 360, flow regulator 1230, and backflow prevention device 1240. As illustrated in FIG. 17, in some examples, the flow controller 2100 may be disposed in a housing 2150. The housing 2150 may include an inlet 2151 configured to receive a flow of water from a water supply, a first outlet 2152 in communication with the closing valve 2110 and a first end (e.g., 242) of a hydraulic cylinder (e.g., 240), a second outlet 2153 in communication with the opening valve 2120 and a second end (e.g., 243) of a hydraulic cylinder (e.g., 240), a third outlet 2154 in communication with an independent rim valve 2130 and the rim outlet 350, and a fourth outlet 2155 in communication with the independent jet valve 2140 and the jet outlet 360.

As described above, the flow controller 2100 and/or the housing 2150 may include a hydraulic turbine 1110, closing valve 2110, opening valve 2120, independent rim valve 2130, independent jet valve 2140, controller 800 and battery 1120. The flow controller 2100 may be disposed within a skirt or shroud of the toilet 2200 at a back and/or bottom of the toilet.

According to various examples of the present disclosure an operational or flush cycle of the toilet 2200 may be performed substantially similarly to the flow charts 600 and 1500 as described herein, except the gate valve 1210 may be opened and/or closed independently of water being provided to the rim outlet 350 and the jet outlet, using the opening valve 2120 and the closing valve 2110, respectively.

When a component, device, element, or the like of the present disclosure is described as having a purpose or performing an operation, function, or the like, the component, device, or element should be considered herein as being "configured to" meet that purpose or to perform that operation or function.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A gate valve for a toilet, the gate valve comprising:
an opening;
a gate configured to selectively block the opening;
a hydraulic cylinder including a piston connected to the gate, the piston configured to move the gate, opening, or closing the gate valve, as the piston moves;
a first inlet disposed at a first end of the hydraulic cylinder; and
a second inlet disposed at a second end of the hydraulic cylinder opposite the first end.

2. The gate valve of claim 1, wherein the piston is disposed between the first inlet and the second inlet.

3. The gate valve of claim 2, wherein the first inlet is configured to convey a first flow of fluid into the hydraulic cylinder, the first flow of fluid moving the piston towards the second end of the hydraulic cylinder.

4. The gate valve of claim 3, wherein the second inlet is configured to convey a second flow of fluid into the hydraulic cylinder, the second flow of fluid moving the piston towards the first end of the hydraulic cylinder.

5. The gate valve of claim 4, wherein the piston is configured to close the gate valve as it moves toward the second end of hydraulic cylinder, and
wherein the piston is configured to open the gate valve as it moves toward the first end of the hydraulic cylinder.

6. The gate valve of claim 1 wherein the first inlet is configured to direct a first flow of fluid into the hydraulic cylinder and is in fluid communication with a rim outlet of a toilet, and
wherein the second inlet is configured to direct a second flow of fluid into the hydraulic cylinder and is in fluid communication with a sump jet outlet of the toilet.

7. A toilet, the toilet comprising:
a bowl including a sump;
a trapway in fluid communication with the sump; and
a gate valve including a gate and a hydraulic cylinder, the gate configured to selectively block the trapway, and the hydraulic cylinder including a piston connected to the gate, the piston configured to move the gate, opening, or closing the gate valve, as the piston moves, a first inlet disposed at a first side of the hydraulic cylinder, and a second inlet disposed at a second side of the hydraulic cylinder,
wherein the piston is disposed between the first inlet and the second inlet.

8. The toilet of claim 7, wherein the first inlet is configured to convey a first flow of fluid into the hydraulic cylinder, the first flow of fluid moving the piston towards a second end of the hydraulic cylinder, and
wherein the second inlet is configured to convey a second flow of fluid into the hydraulic cylinder, the second flow of fluid moving the piston towards a first end of the hydraulic cylinder.

9. The toilet of claim 8, further comprising:
a rim outlet disposed at a rim of the bowl;
a sump jet outlet disposed at the sump;
a rim valve configured to control the first flow of fluid to the rim outlet and to the first inlet; and
a sump valve configured to control the second flow of fluid to the sump jet outlet and the second inlet.

10. The toilet of claim 9, further comprising:
an auxiliary valve disposed between the first inlet and the rim outlet,
wherein the rim outlet is disposed downstream of the first inlet.

11. The toilet of claim 10, wherein when the rim valve is in an open position and the auxiliary valve is in a closed position, an entirety of the first flow is provided to the hydraulic cylinder.

12. The toilet of claim 9, wherein the first flow of fluid is configured to move the piston toward the second end of the hydraulic cylinder, closing the gate valve.

13. The toilet of claim 12, wherein the second flow of fluid is configured to move the piston toward the first end of the hydraulic cylinder, opening the gate valve.

14. The toilet of claim 9, further comprising:

a vent channel extending from an inlet at a top of the trapway upstream of the gate valve to an outlet in the trapway downstream of the gate valve.

15. The toilet of claim 14, further comprising:

a vent channel valve configured to selectively open or close the vent channel.

16. A method of flushing a toilet, the method comprising:

opening a first valve, an inlet of the first valve in communication with a water supply and an outlet of the first valve in communication with a hydraulic cylinder and a rim outlet disposed in a bowl of the toilet;

providing a first flow of water through the first valve, the first flow of water rinsing the bowl;

closing the first valve;

opening a second valve, an inlet of the second valve in communication with the water supply and an outlet of the second valve in communication with the hydraulic cylinder and a sump outlet disposed in a sump of the toilet;

providing a second flow of water through the second valve, the second flow of water opening a gate valve disposed in a trapway of the toilet and flowing into the sump;

closing the second valve;

opening the first valve;

providing a third flow of water through the first valve, the third flow of water closing the gate valve, rinsing the bowl, and filling the bowl; and closing the first valve.

17. The method of claim 16, wherein the second flow of water moves a piston disposed in the hydraulic cylinder and connected to the gate valve, opening the gate valve and wherein the third flow of water moves the piston, closing the gate valve.

18. The method of claim 16, further comprising:

opening a vent channel valve after the second flow of water flows into the sump;

and closing a vent channel valve after the third flow of water fills the bowl and the first valve closes.

* * * * *